US009164424B2

(12) United States Patent
Nakamura et al.

(10) Patent No.: US 9,164,424 B2
(45) Date of Patent: Oct. 20, 2015

(54) CARTRIDGE WITH FLEXIBLE DEVELOPER BAG AND ELASTIC MEMBER FOR ACTING ON THE DEVELOPER BAG

(71) Applicant: CANON KABUSHIKI KAISHA, Tokyo (JP)

(72) Inventors: Yuuki Nakamura, Mishima (JP); Yoshiyuki Batori, Suntou-gun (JP); Takatoshi Hamada, Mishima (JP); Toshiaki Takeuchi, Susono (JP); Daisuke Makiguchi, Izunokuni (JP); Tomofumi Kawamura, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/163,171

(22) Filed: Jan. 24, 2014

(65) Prior Publication Data

US 2014/0212181 A1 Jul. 31, 2014

(30) Foreign Application Priority Data

Jan. 25, 2013 (JP) ..... 2013-011988

(51) Int. Cl.
*G03G 15/08* (2006.01)

(52) U.S. Cl.
CPC ..... *G03G 15/0874* (2013.01); *G03G 2215/068* (2013.01); *G03G 2215/0682* (2013.01)

(58) Field of Classification Search
CPC ..... G03G 15/0874; G03G 2215/0682
USPC ..... 399/258, 262; 222/85, 105, 107, 202, 222/203, DIG. 1
See application file for complete search history.

(56) References Cited

U.S. PATENT DOCUMENTS

| | | | | | |
|---|---|---|---|---|---|
| 3,847,304 | A | * | 11/1974 | Cohen | 222/105 |
| 4,000,833 | A | * | 1/1977 | Marks | 222/105 |
| 4,417,802 | A | * | 11/1983 | Forbes, II | 399/258 |
| 4,647,180 | A | * | 3/1987 | Watanabe | 399/258 |
| 4,766,457 | A | * | 8/1988 | Barker et al. | 399/106 |
| 5,079,591 | A | * | 1/1992 | Tomita et al. | 399/262 |
| 5,148,223 | A | * | 9/1992 | Cipolla | 399/258 |
| 5,559,581 | A | | 9/1996 | Sugiura et al. | |
| 5,561,496 | A | | 10/1996 | Sugiura et al. | |
| 5,594,535 | A | * | 1/1997 | Beaufort et al. | 399/262 |
| 5,634,178 | A | | 5/1997 | Sugiura et al. | |
| 5,911,096 | A | | 6/1999 | Batori et al. | |
| 5,920,753 | A | | 7/1999 | Sasaki et al. | |
| 5,930,562 | A | | 7/1999 | Noda et al. | |
| 5,937,237 | A | | 8/1999 | Nonaka et al. | |
| 5,940,658 | A | | 8/1999 | Yokoi et al. | |

(Continued)

FOREIGN PATENT DOCUMENTS

| | | | | |
|---|---|---|---|---|
| JP | 63210867 | A | * | 9/1988 |
| JP | H 4-66980 | | | 3/1992 |
| JP | 2008224820 | A | * | 9/2008 |

*Primary Examiner* — Robert Beatty
(74) *Attorney, Agent, or Firm* — Fitzpatrick, Cella, Harper & Scinto

(57) ABSTRACT

A cartridge detachably mountable to a main assembly of an image forming apparatus includes: a frame; a flexible developer bag, provided with an opening and provided inside the frame, for containing a developer; and an elastic member for discharging the developer through the opening by acting on the developer bag. The elastic member is extended from a free state by contact with the developer bag, and elastic energy accumulated by extension of the elastic member acts on the developer bag to discharge the developer through the opening.

18 Claims, 21 Drawing Sheets

(56) References Cited

U.S. PATENT DOCUMENTS

| | | | | |
|---|---|---|---|---|
| 5,960,238 | A * | 9/1999 | Ohgami | 399/258 |
| 6,075,957 | A | 6/2000 | Batori et al. | |
| 6,084,622 | A | 7/2000 | Sugiura et al. | |
| 6,101,348 | A | 8/2000 | Nonaka et al. | |
| 6,131,007 | A | 10/2000 | Yamaguchi et al. | |
| 6,275,668 | B1 | 8/2001 | Batori | |
| 6,334,035 | B1 | 12/2001 | Abe et al. | |
| 6,363,226 | B1 | 3/2002 | Batori | |
| 6,546,214 | B2 | 4/2003 | Sakai et al. | |
| 6,615,002 | B2 | 9/2003 | Saito et al. | |
| 6,714,746 | B2 | 3/2004 | Morioka et al. | |
| 6,937,832 | B2 | 8/2005 | Sato et al. | |
| 6,963,706 | B2 | 11/2005 | Morioka et al. | |
| 7,065,313 | B2 * | 6/2006 | Matsumoto et al. | 399/262 |
| 7,079,787 | B2 | 7/2006 | Ogino et al. | |
| 7,127,192 | B2 | 10/2006 | Batori et al. | |
| 7,136,604 | B2 | 11/2006 | Chadani et al. | |
| 7,200,349 | B2 | 4/2007 | Sato et al. | |
| 7,418,225 | B2 | 8/2008 | Morioka et al. | |
| 7,885,575 | B2 | 2/2011 | Batori et al. | |
| 8,036,543 | B2 | 10/2011 | Yokomori et al. | |
| 8,081,898 | B2 | 12/2011 | Batori et al. | |
| 8,180,251 | B2 | 5/2012 | Nakamura et al. | |
| 8,275,283 | B2 | 9/2012 | Uneme et al. | |
| 8,326,178 | B2 | 12/2012 | Nakamura et al. | |
| 8,326,185 | B2 | 12/2012 | Asanuma et al. | |
| 8,401,441 | B2 | 3/2013 | Uneme et al. | |
| 8,406,656 | B2 | 3/2013 | Batori et al. | |
| 8,565,640 | B2 | 10/2013 | Batori et al. | |
| 8,644,732 | B2 | 2/2014 | Kikuchi et al. | |
| 8,676,085 | B1 | 3/2014 | Batori et al. | |
| 8,687,994 | B2 | 4/2014 | Nakamura et al. | |
| 2012/0104041 | A1 * | 5/2012 | Coleman et al. | 222/95 |
| 2012/0183328 | A1 | 7/2012 | Nakamura et al. | |
| 2014/0064776 | A1 | 3/2014 | Yamasaki et al. | |
| 2014/0064793 | A1 * | 3/2014 | Matsuzaki et al. | 399/258 |
| 2014/0086620 | A1 | 3/2014 | Takeuchi et al. | |
| 2014/0086621 | A1 | 3/2014 | Makiguchi et al. | |
| 2014/0086632 | A1 | 3/2014 | Batori et al. | |
| 2014/0093272 | A1 | 4/2014 | Matsumaru et al. | |
| 2014/0105639 | A1 | 4/2014 | Kikuchi et al. | |
| 2014/0126928 | A1 | 5/2014 | Batori et al. | |
| 2014/0212166 | A1 | 7/2014 | Takeuchi et al. | |

* cited by examiner (a)

(b)

(c)

(a)

(b)

(c)

(a)

(b)

(c)

(a)

(b)

CARTRIDGE WITH FLEXIBLE DEVELOPER BAG AND ELASTIC MEMBER FOR ACTING ON THE DEVELOPER BAG

FIELD OF THE INVENTION AND RELATED ART

The present invention relates to a cartridge, a developing cartridge, a process cartridge and an image forming apparatus using the developing cartridge.

A device, including a developing roller, for visualizing an electrostatic latent image, with a developer by using the developing roller, formed on a surface of an electrophotographic photosensitive drum as an image bearing member is a developing device. Here, the developing cartridge is prepared by integrally assembling the developing device into a cartridge, and is to be detachably mounted to a main assembly of an electrophotographic image forming apparatus.

Further, the process cartridge is prepared by integrally assembling the electrophotographic photosensitive drum and the developing device actable on the electrophotographic photosensitive drum into a cartridge, and is to be detachably mounted to the electrophotographic image forming apparatus main assembly. Further, the electrophotographic image forming apparatus forms an image on a recording material (medium) such as a sheet material by using an electrophotographic image forming type.

Examples of the electrophotographic image forming apparatus may include an electrophotographic copying machine; an electrophotographic printer such as an LED (light emitting diode) printer or a laser beam printer; a facsimile machine; a word processor; and the like.

In a conventional electrophotographic image forming apparatus using an electrophotographic image forming process, a process cartridge type in which an electrophotographic photosensitive member and a process means actable on the photosensitive member are integrally assembled into a cartridge and this cartridge is made detachably mountable to the electrophotographic image forming apparatus main assembly is employed. In the developing device used in such a process cartridge, in a toner chamber for accommodating a developer (hereinafter referred to as a toner), the toner is directly accommodated.

Further, the toner is scattered in the process cartridge in a toner filling step during manufacturing of the process cartridge. For this reason, Japanese Laid-Open Patent Application (JP-A) Hei 4-66980 proposes that a deformable inside container in which the toner is contained (confined) (hereinafter referred to as a "toner bag") is accommodated in a toner chamber.

However, in JP-A Hei 4-66980, in a constitution in which a bottom surface of the toner bag is not provided with inclination (tilt) enough to permit fall (drop) of the toner by its own weight, it is difficult to discharge the toner in some cases. Further, also in a constitution in which an opening for the toner bag cannot be formed in a lower side with respect to a direction of gravitation, there is the case where it is different to discharge the toner.

SUMMARY OF THE INVENTION

The present invention has solved the above problem. A principal object of the present invention is to provide a cartridge capable of permitting satisfactory discharge of a developer contained in a flexible developer bag to decrease a remaining amount of the developer.

According to an aspect of the present invention, there is provided a cartridge detachably mountable to a main assembly of an image forming apparatus, comprising: a frame; a flexible developer bag, provided with an opening and provided inside the frame, for containing a developer; and an elastic member for discharging the developer through the opening by acting on the developer bag, wherein the elastic member is extended from a free state by contact with the developer bag, and elastic energy accumulated by extension of the elastic member acts on the developer bag to discharge the developer through the opening.

These and other objects, features and advantages of the present invention will become more apparent upon a consideration of the following description of the preferred embodiments of the present invention taken in conjunction with the accompanying drawings.

Figure 9:
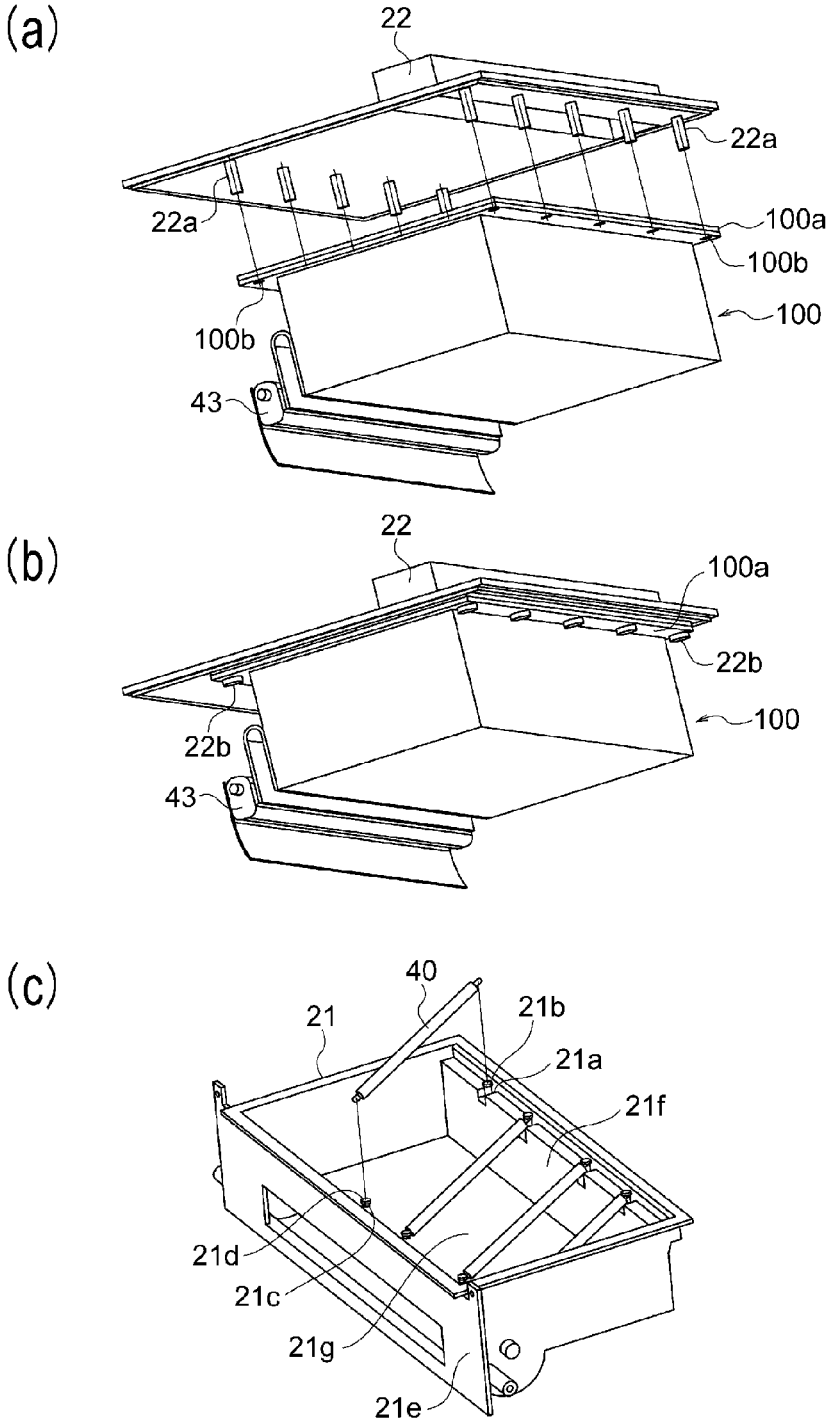

Parts (a) and (b) of FIG. 9 are perspective views for illustrating a fixing method of the developer bag provided in the cartridge according to the present invention, and (c) of FIG. 9 is a perspective view for illustrated a fixing method of an elastic member provided in the cartridge in Embodiment 1.

Figure 10:
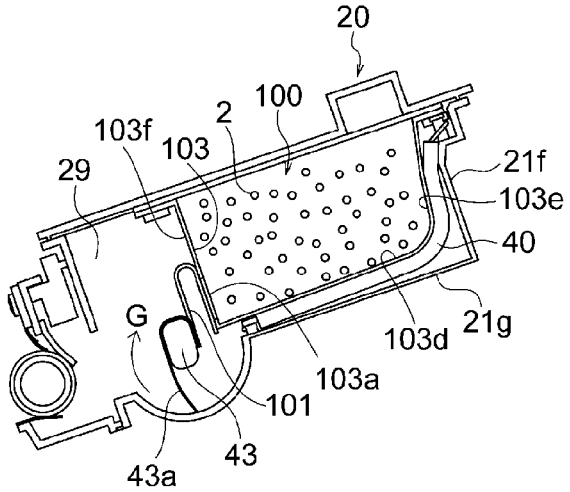
Figure 10:
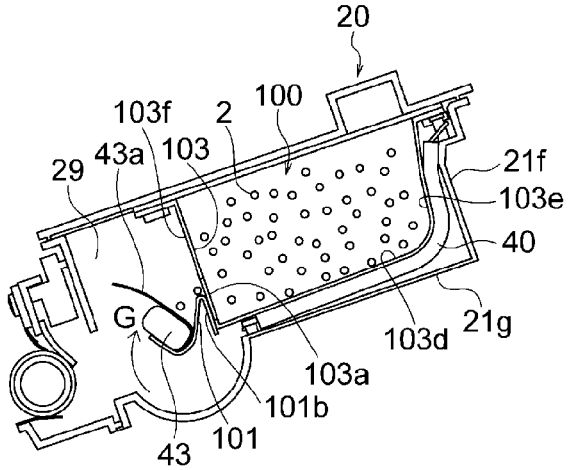
Figure 10:
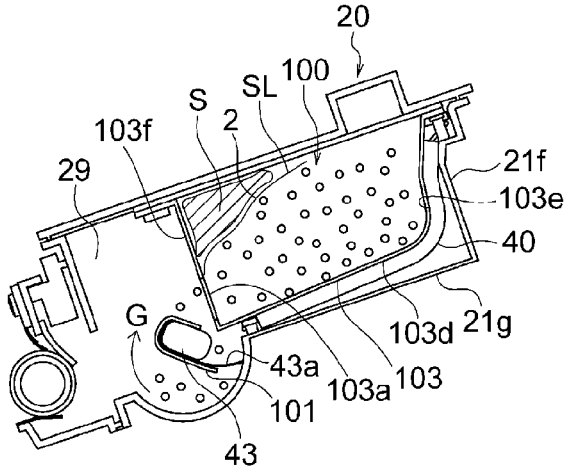

Parts (a) to (c) of FIG. 10 are sectional illustrations showing an unsealing method of the developer bag provided in the cartridge in Embodiment 1.

Figure 11:
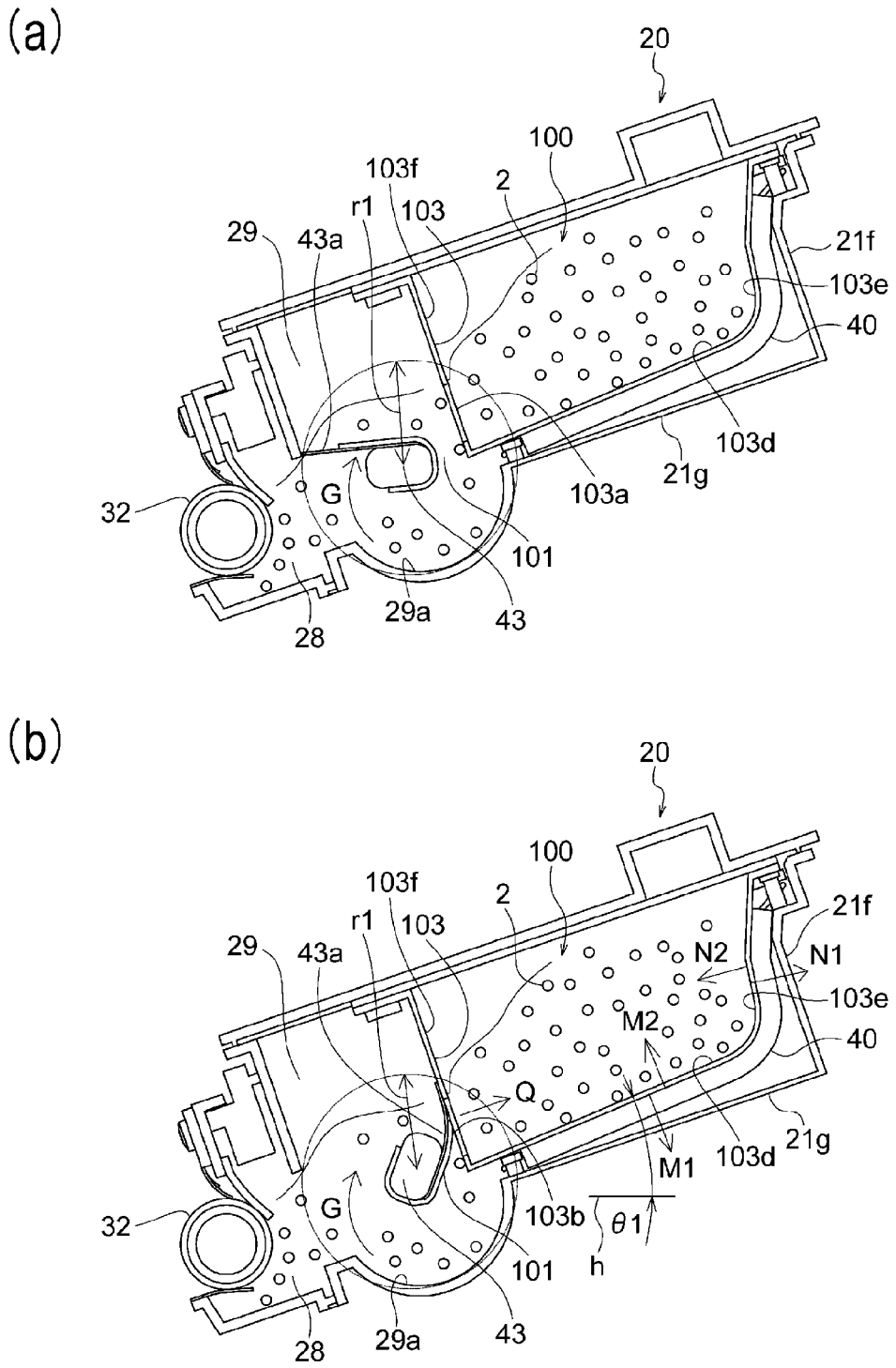

Parts (a) and (b) of FIG. 11 are sectional illustrations showing a state in which a developer is discharged through an opening of the developer bag provided in the cartridge in Embodiment 1.

Figure 12:
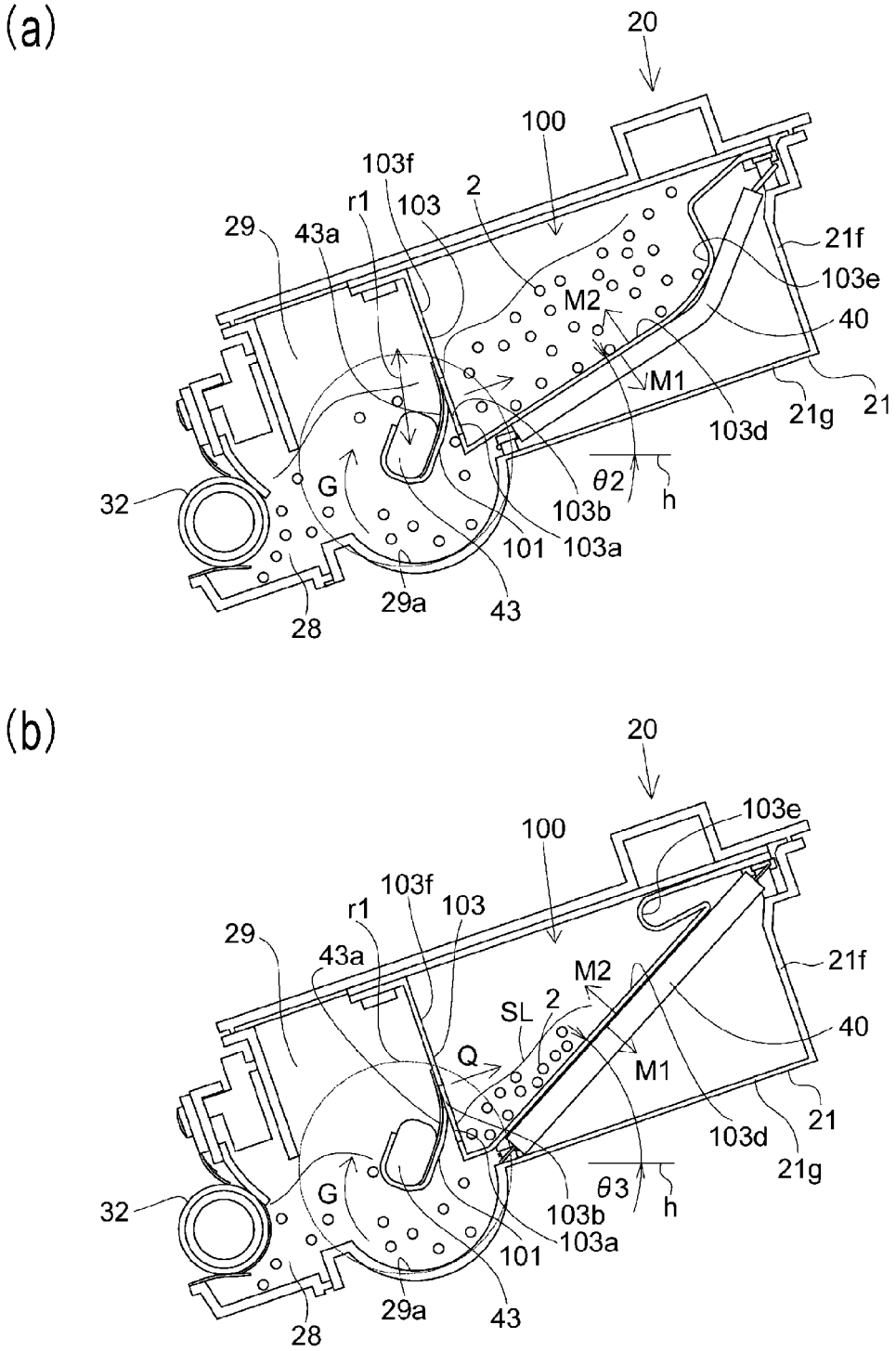

Parts (a) and (b) of FIG. 12 are sectional illustrations showing the state in which the developer is discharged through the opening of the developer bag provided in the cartridge in Embodiment 1.

Figure 13:
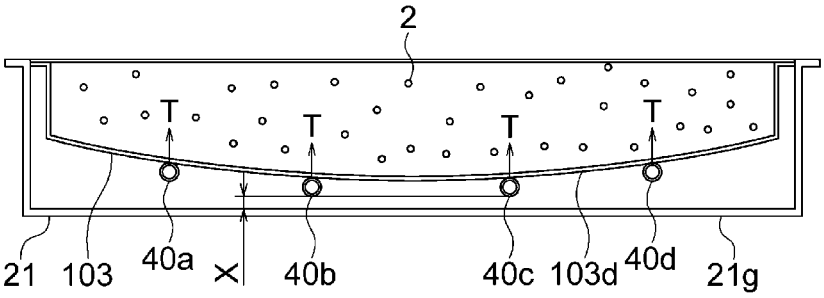
Figure 13:
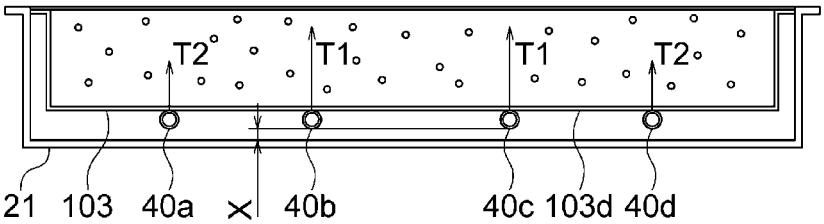
Figure 13:
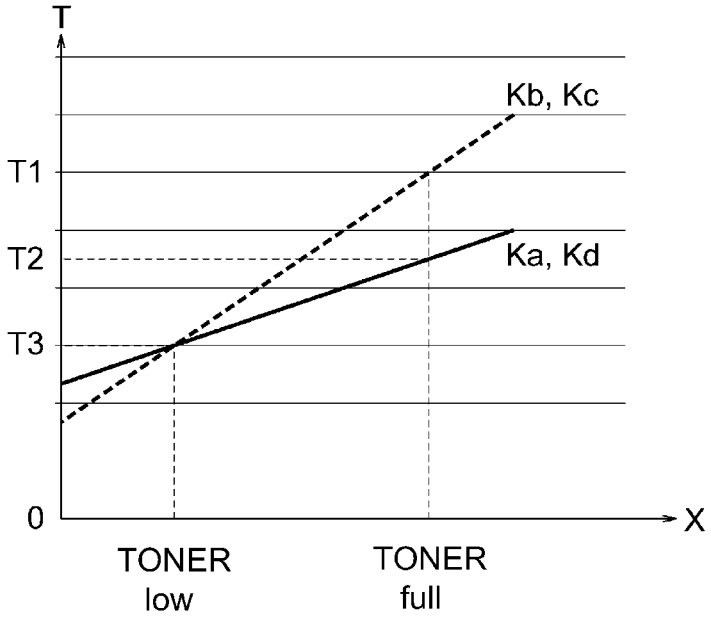

Parts (a) and (b) of FIG. 13 are sectional illustrations for illustrating an action of the elastic member, and (c) of FIG. 13 is a graph for illustrating an example of setting of a spring constant of the elastic member.

Figure 14:
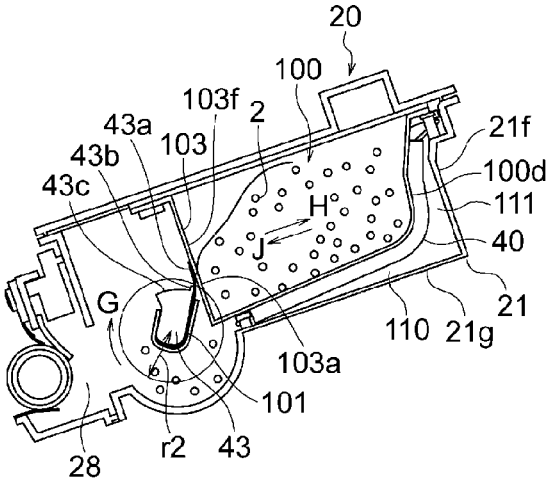
Figure 14:
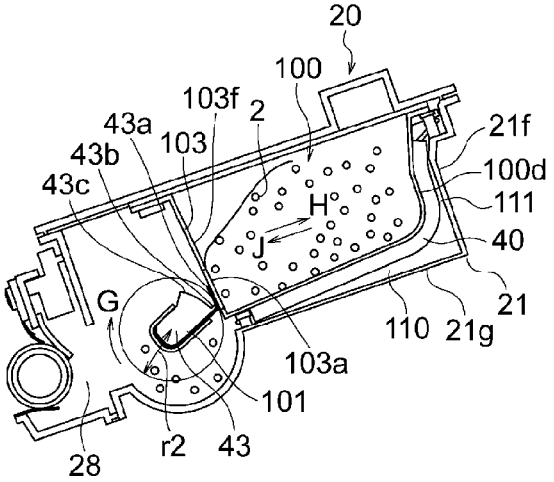
Figure 14:
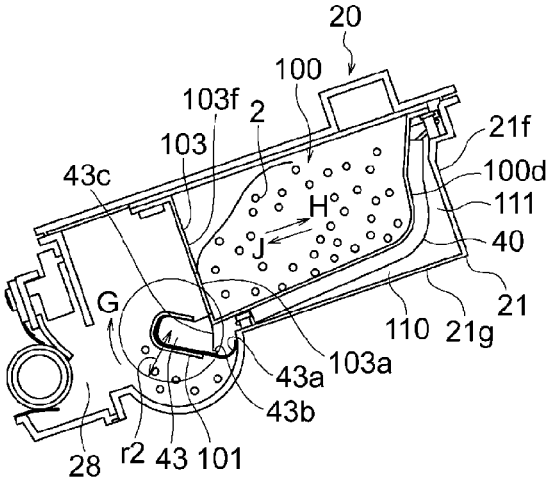

Parts (a) to (c) of FIG. 14 are sectional illustrations showing a state in which a developer is discharged through an opening of a developer bag provided in the cartridge according to the present invention in Embodiment 2.

Figure 15:
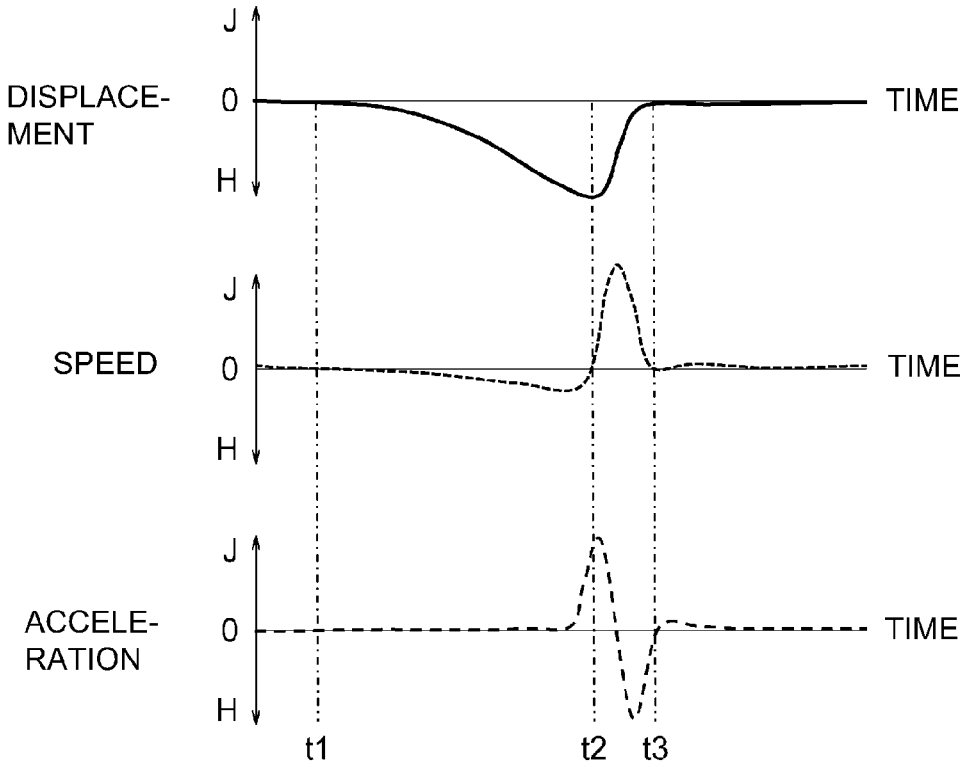

FIG. 15 includes diagrams each showing a result of an experiment of behavior of the developer bag when an acting member periodically acts on the developer bag.

Figure 16:
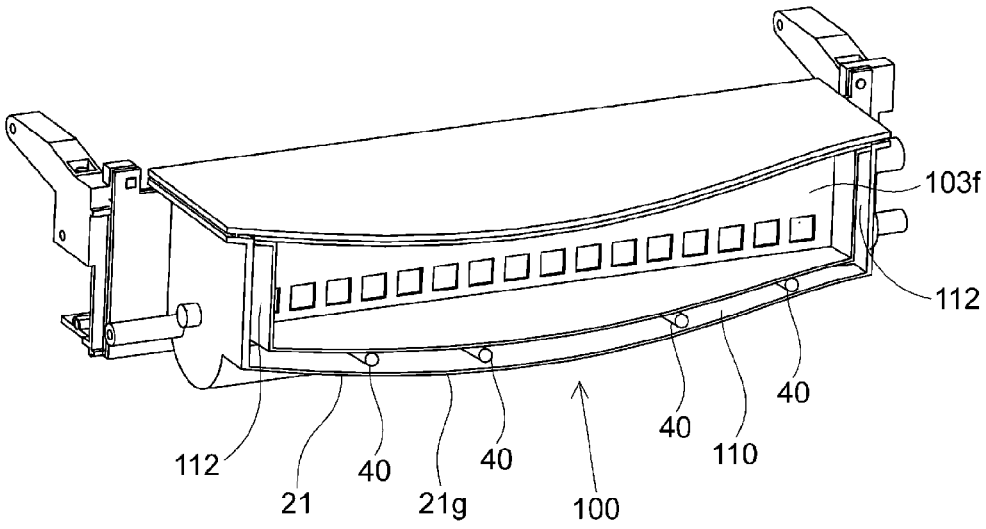

FIG. 16 is a perspective view showing an arrangement of the developer bag.

Figure 17:
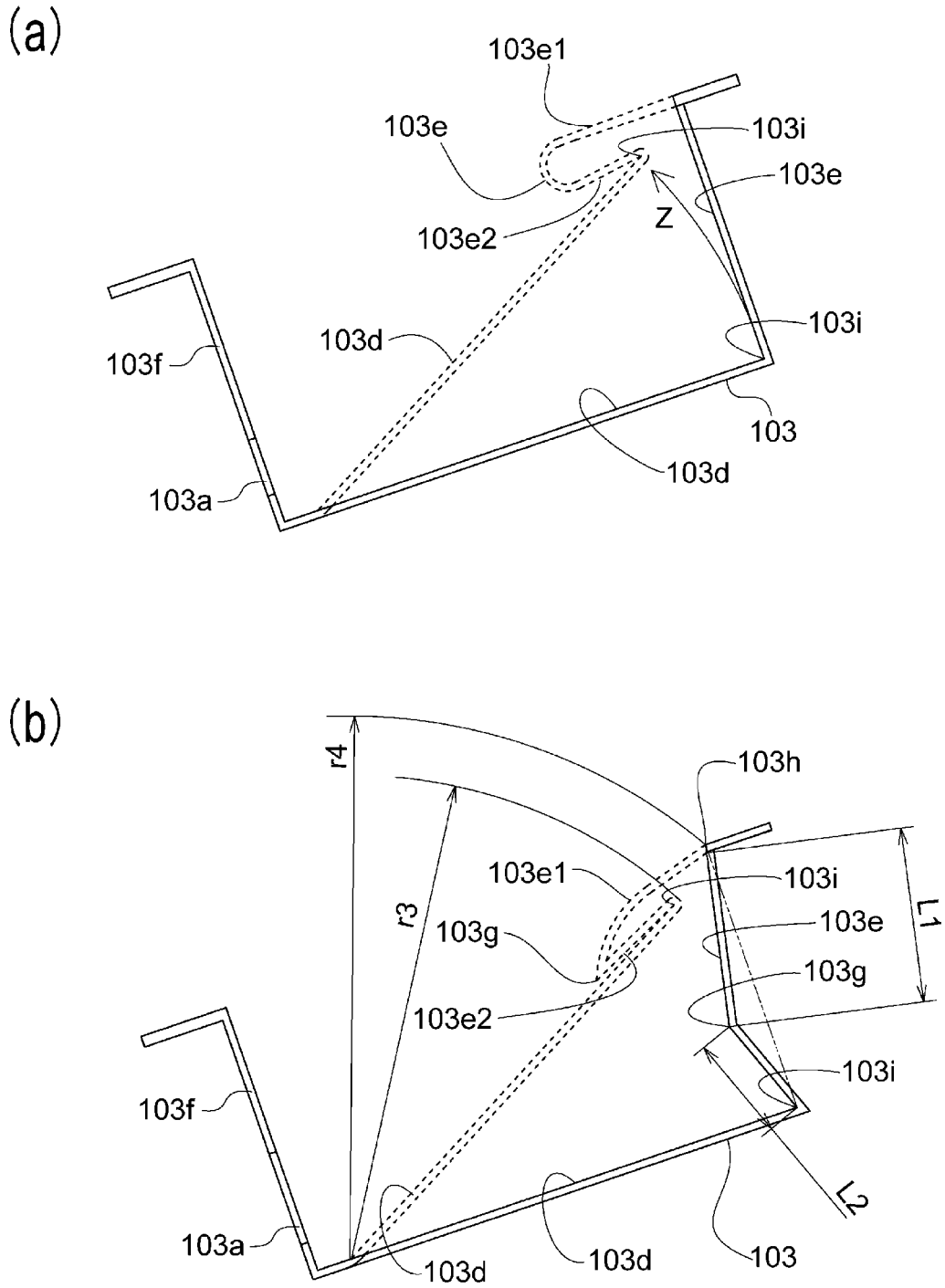

Parts (a) and (b) of FIG. 17 are sectional illustrations showing a state in which a crease formed at a rear surface portion in a position opposite from an opening of the developer bag is projected toward a space in which the developer is contained.

Figure 18:
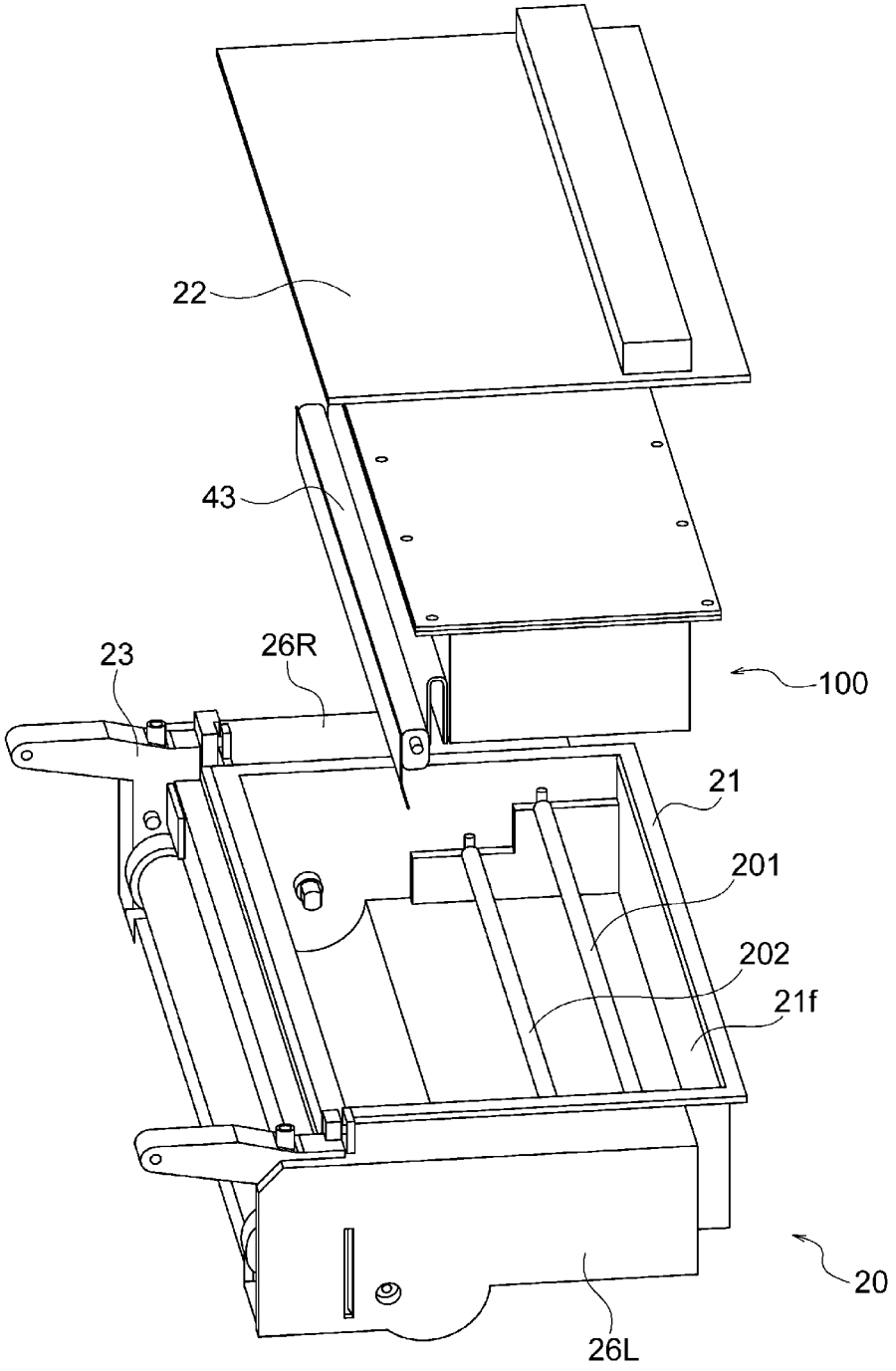

FIG. 18 is an exploded perspective view for illustrating a fixing position of an elastic member provided in the cartridge according to the present invention in Embodiment 3.

Figure 19:
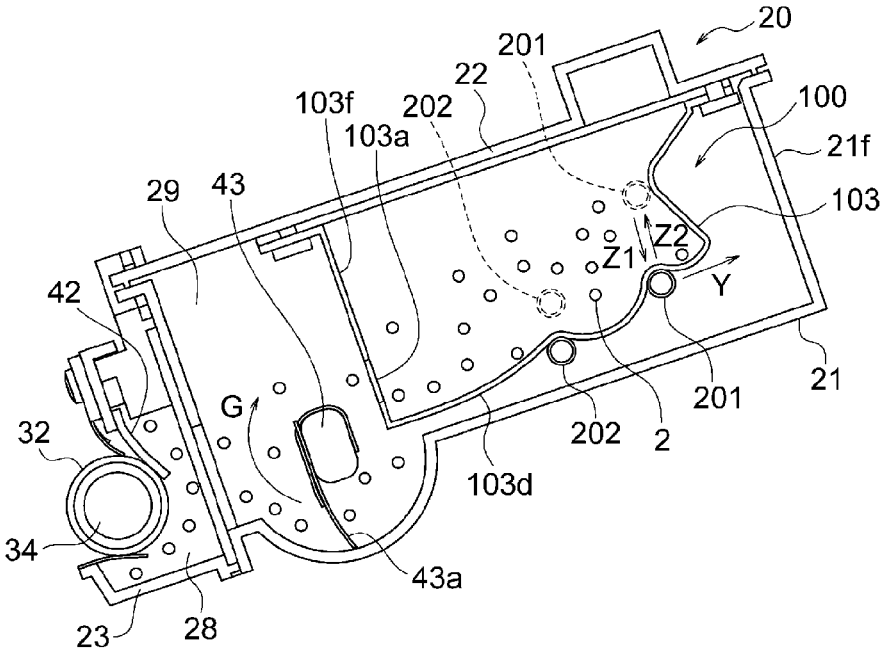
Figure 19:
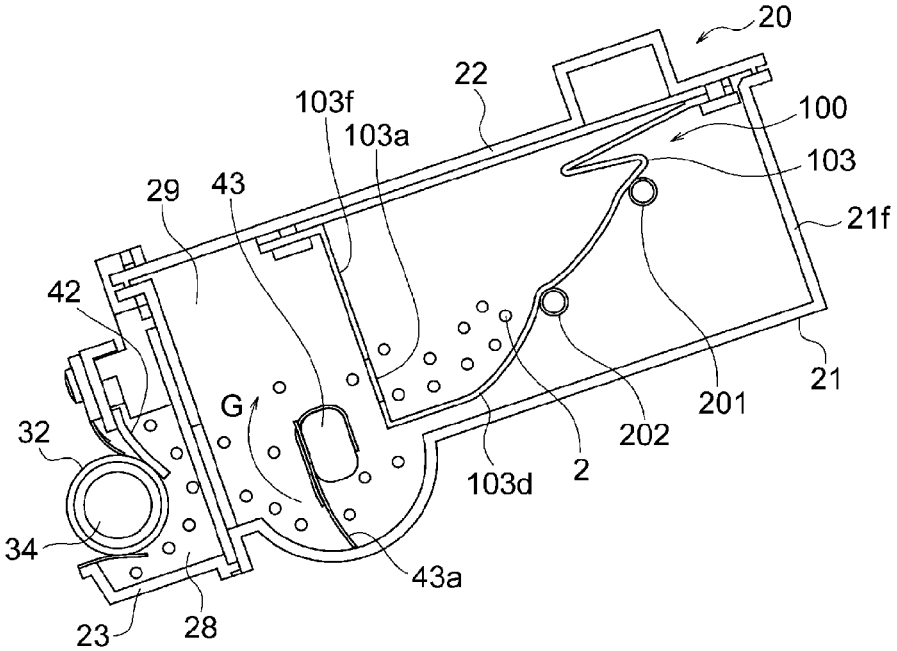

Parts (a) and (b) of FIG. 19 are sectional illustrations of a developing unit for illustrating a positional relationship between a developer bag and the elastic member in Embodiment 3.

Figure 20:
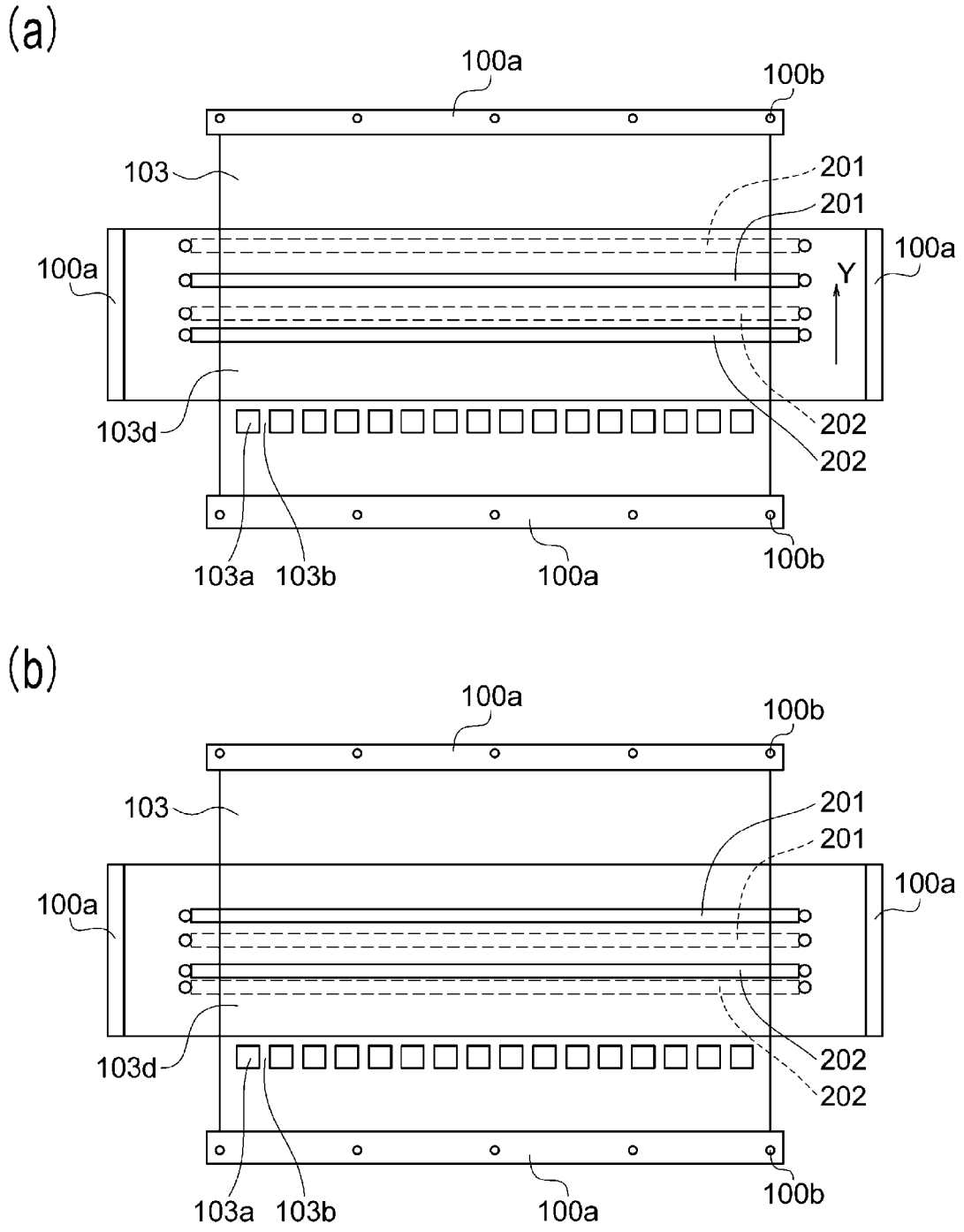

Parts (a) and (b) of FIG. 20 are plan views for illustrating the positional relationship between the developer bag and the elastic member in Embodiment 3.

Figure 21:
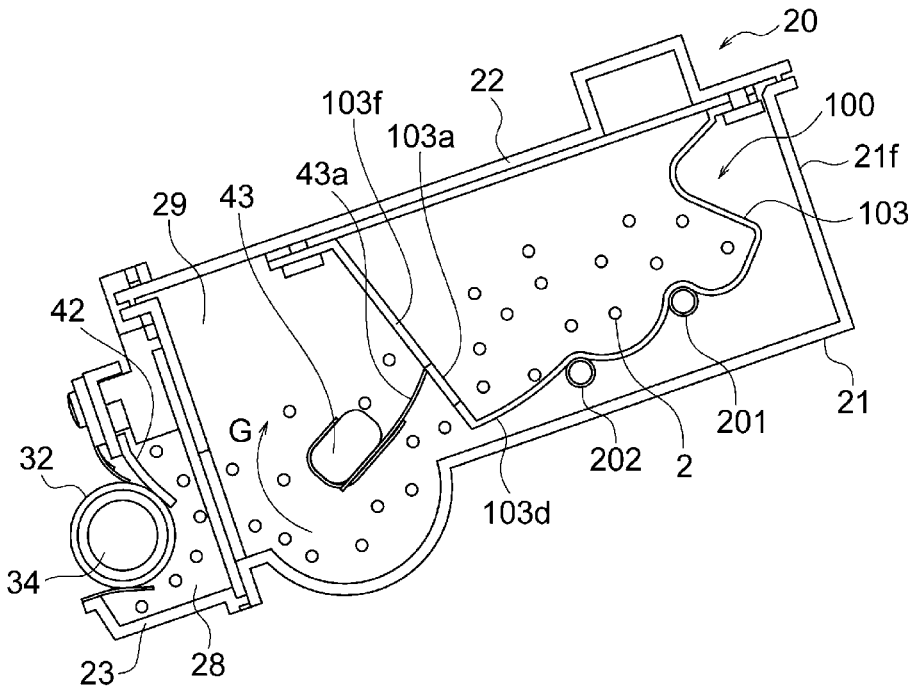

FIG. 21 is a sectional illustration of the developing unit for illustrating the positional relationship between the developer bag and the elastic member in Embodiment 3.

Figure 22:
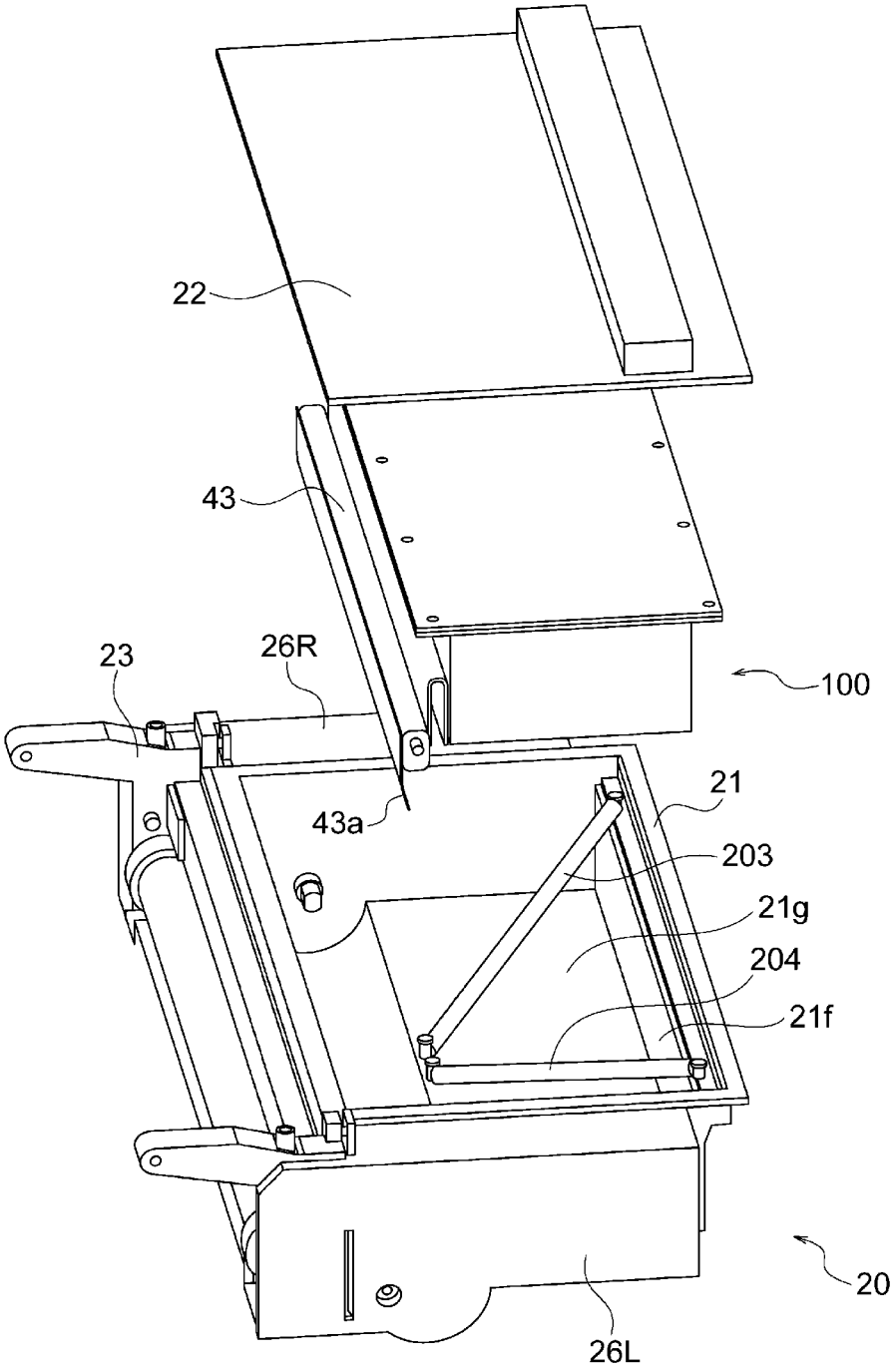

FIG. 22 is an exploded perspective view for illustrating a fixing position of an elastic member provided in the cartridge according to the present invention in Embodiment 4.

Figure 23:
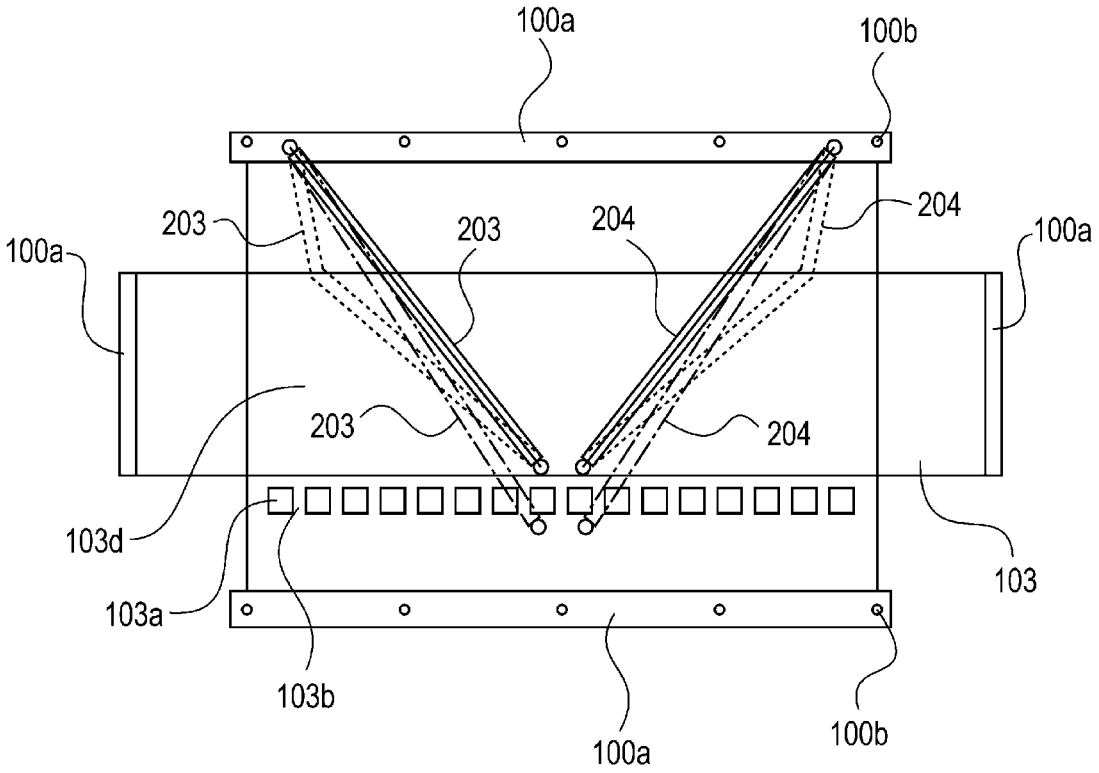

FIG. 23 is a plan view for illustrating a positional relationship between a developer bag and the elastic member in Embodiment 4.

Figure 24:
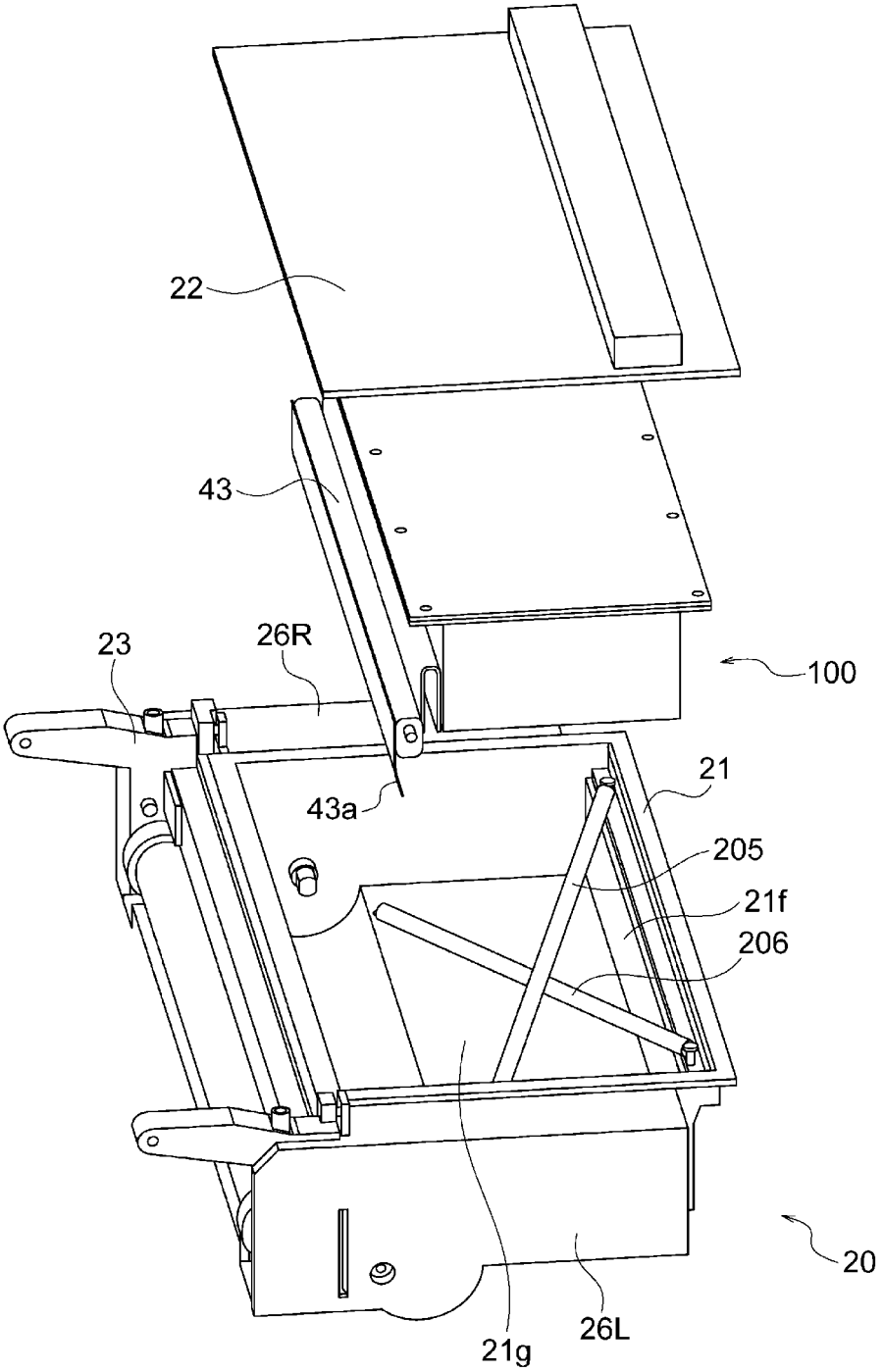

FIG. 24 is an exploded perspective view for illustrating a fixing position of an elastic member provided in the cartridge according to the present invention in Embodiment 5.

DESCRIPTION OF EMBODIMENTS

With reference to the drawings, embodiments of a cartridge, a developing cartridge, a process cartridge and an image forming apparatus will be described specifically.

[Embodiment 1]

First, structures of the cartridge, the developing cartridge, the process cartridge and the image forming apparatus according to the present invention in this embodiment will be described with reference to FIGS. 1 to 13. Incidentally, in the following description, a rotational axis direction of a photosensitive drum 62 as an image bearing member on which an electrostatic latent image is to be formed on a surface of the photosensitive drum 62 is referred to as a longitudinal direction of a cartridge B.

Figure 5:
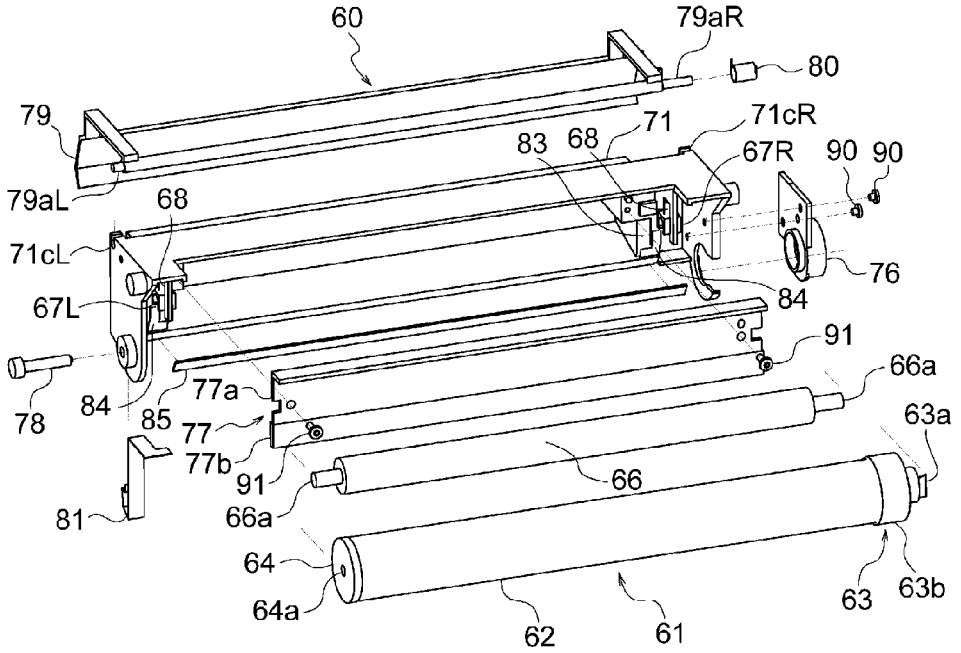
FIG. 5 is an exploded perspective view showing a structure of a cleaning unit.

Further, with respect to the longitudinal direction of the cartridge B, a side where the photosensitive drum 62 receives a driving force from a main assembly of an image forming apparatus A (image forming apparatus main assembly) is referred to as a driving side (where a driving force-receiving portion 63*a* shown in a right side of FIG. 5 is provided), and its opposite side is referred to as a non-driving side.

Figure 1:
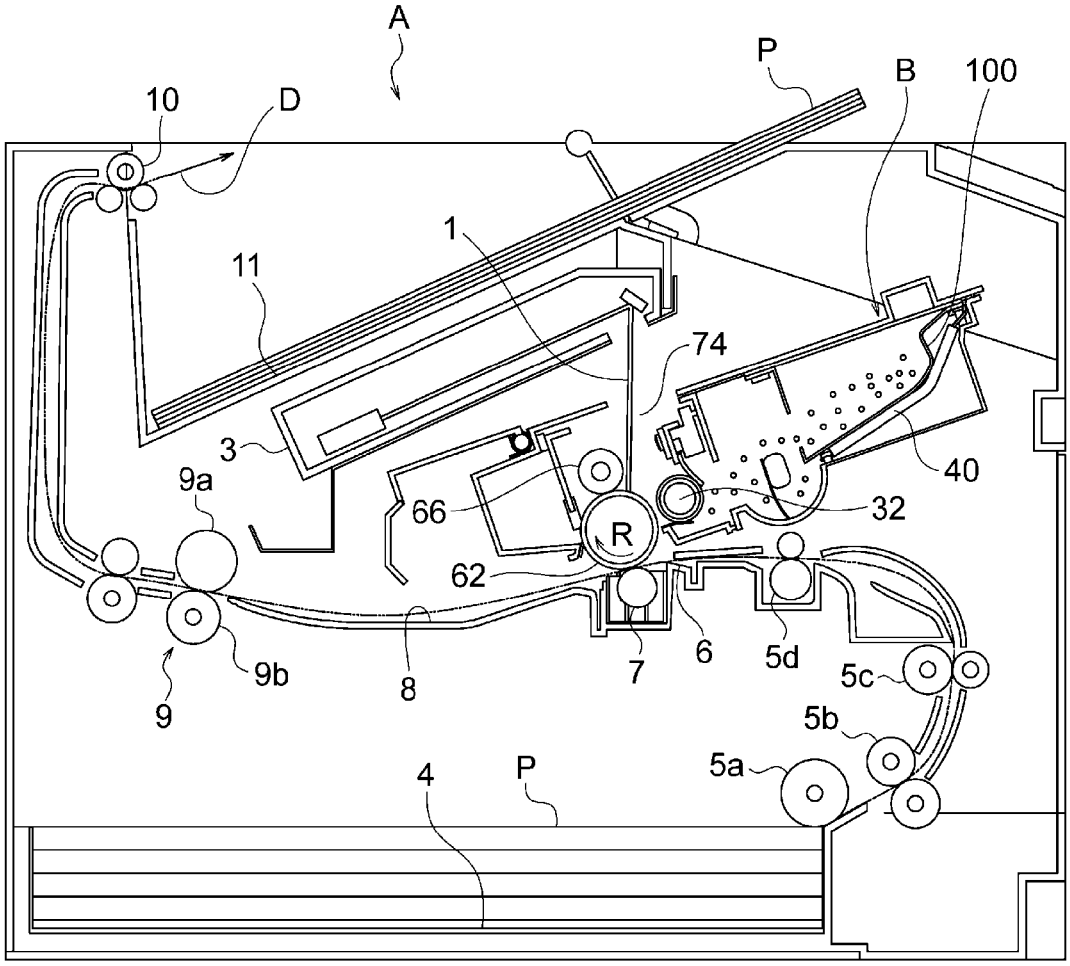
FIG. 1 is a sectional illustration showing a structure of an image forming apparatus in which a cartridge as a process cartridge according to the present invention in Embodiment 1.
Figure 3:
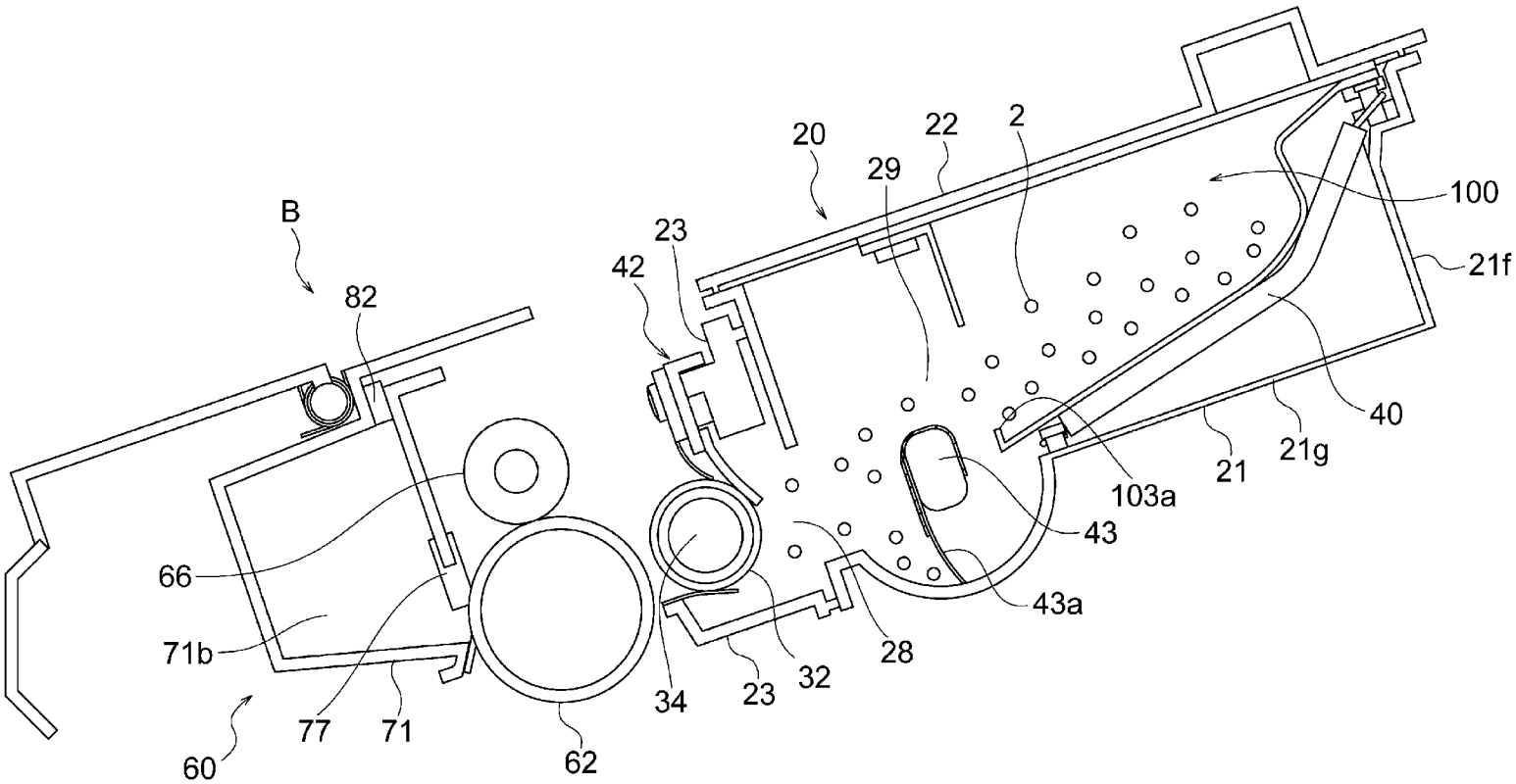
FIG. 3 is a sectional illustration showing a structure of the process cartridge to which the cartridge according to the present invention in Embodiment 1 is applied.

A general structure of the image forming apparatus A and an image forming process will be described with reference to FIGS. 1 and 3. FIG. 1 is a sectional view of the main assembly of the image forming apparatus A of an electrophotographic type as and a process cartridge (hereinafter referred to as a cartridge B). FIG. 3 is a sectional view of the cartridge B. Here, the main assembly of the image forming apparatus A refers to a portion of the image forming apparatus A from which the cartridge B is removed.

<Image Forming Apparatus>

The image forming apparatus A shown in FIG. 1 is an example of a laser beam printer, using an electrophotographic technique, in which the cartridge B is detachably mountable to the main assembly of the image forming apparatus A. When the cartridge B is mounted in the main assembly of the image forming apparatus A, above the cartridge B in FIG. 1, a laser scanner unit 3 as an exposure means is provided.

Further, below the process cartridge B in FIG. 1, a sheet (feeding) tray 4 in which a sheet material P to be subjected to image formation is accommodated is provided. Further, in the main assembly of the image forming apparatus A, along a feeding (conveyance) direction D of the sheet material S, a pick-up roller 5*a*, a feeding roller 5*b*, a conveying roller 5*c* and a registration roller 5*d* are provided. Further, a transfer guide 6, a transfer roller 7, a conveying guide 8, a fixing device 9, a discharging roller 10, a discharge tray 11 and the like are successively provided. Incidentally, the fixing device 9 is constituted by a heating roller 9*a* and a pressing roller 9*b*.

<Image Forming Process>

Next, an image forming process operation will be described. On the basis of a print start signal, the photosensitive drum 62 is rotationally driven at a predetermined peripheral speed (process speed) in an arrow R direction in FIG. 1. A charging roller 66 to which a charging bias voltage is applied from an unshown charging bias power source contacts the outer peripheral surface of the photosensitive drum 62 and electrically charges the outer peripheral surface of the photosensitive drum 62 uniformly.

The laser scanner unit 3 outputs laser light 1 depending on image information. The laser light 1 passes through an exposure window portion 74 provided at an upper surface of the process cartridge B, so that the outer peripheral surface of the photosensitive drum 62 is subjected to scanning exposure. As a result, on the outer peripheral surface of the photosensitive drum 62, an electrostatic latent image depending on the image information is formed.

On the other hand, as shown in FIG. 3, in a developing unit 20 as the developing device, a toner 2 as the developer in a toner chamber 29 is fed to a toner feeding chamber 28 communicating with the toner chamber 29 by rotation of a feeding member 43, for feeding the toner 2 contained in the cartridge B, having an elongated circular shape in cross section.

The toner 2 is carried on a surface of a developing roller 32 as a developer carrying member by a magnetic force of a magnet roller 34 formed with a fixed magnet. The toner 2 is regulated in a predetermined layer thickness by a developing blade 42 while being triboelectrically charged. The toner 2 is transferred and supplied, depending on the electrostatic latent image, onto the surface of the photosensitive drum 62, so that the electrostatic latent image is visualized as a toner image.

Further, as shown in FIG. 1, in synchronism with output timing of the laser light 1, by the pick-up roller 5*a* the feeding roller 5*b* and the conveying roller 5*c*, the sheet material P accommodated in the feeding tray 4 provided at a lower portion of the main assembly of the image forming apparatus A is fed.

Further, the sheet material P is conveyed by the registration roller 5*d* so that a leading end position thereof coincides with a writing position of the toner image formed on the surface of the photosensitive drum 62. Then, the sheet material P is supplied via the transfer guide 6, to a transfer position as a nip between the photosensitive drum 62 and the transfer roller 7.

Further, a transfer bias voltage is applied from an unshown transfer bias power source to the transfer roller 7, so that the toner image (image) formed on the surface of the photosensitive drum 62 is successively transferred onto the sheet material in the transfer position between the photosensitive drum 62 and the transfer roller 7. The sheet material P on which the toner image is transferred is separated from the photosensitive drum 62 and then is conveyed to the fixing device 9 along the conveying guide 8. Then, the sheet material P passes through a nip between the heating roller 9*a* and the pressing roller 9*b* which constitute the fixing device 9.

The toner image is heated and pressed at the nip, so that the toner image is fixed on the sheet material P. The sheet material P on which the toner image is fixed is conveyed to the discharging roller 10 and then is discharged onto the discharge tray 11.

On the other hand, as shown in FIG. 3, the surface of the photosensitive drum 62 after the transfer is, from which a residual toner at an outer peripheral surface is removed by a cleaning blade 77, used again in the image forming process. The residual toner removed from the photosensitive drum 62 is stored in a residual toner chamber 71*b* of a cleaning unit 60.

In the above constitution, the charging roller 66, the developing roller 32 and the cleaning blade 77 are the image forming process means actable on the photosensitive drum 62.

<Mounting and Demounting Operation of Cartridge>

Figure 2:
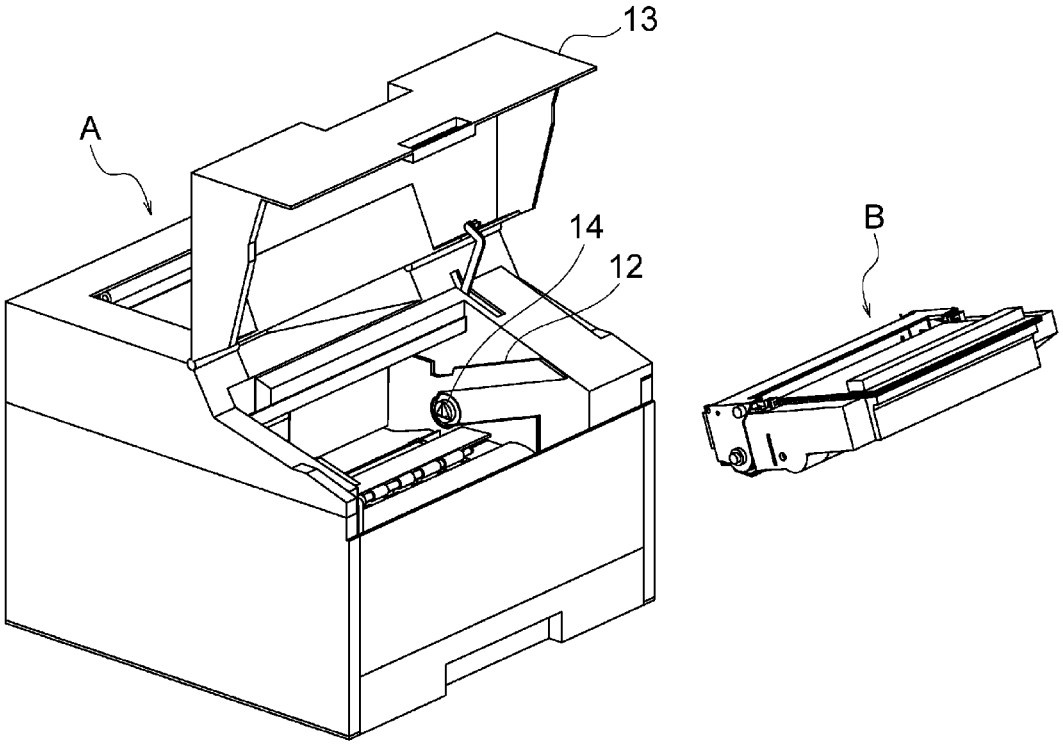
FIG. 2 is a perspective illustration showing an image forming apparatus main assembly and the cartridge in a state in which an openable door is opened when the cartridge according to the present invention is mounted and demounted as a developing cartridge or the process cartridge.

Next, a mounting and demounting operation of the cartridge B with respect to the main assembly of the image forming apparatus A will be described with reference to FIG. 2. FIG. 2 is a perspective view showing the main assembly of the image forming apparatus A in which an openable door 13 is opened for mounting and demounting the process cartridge B, and showing the cartridge B.

The main assembly of the image forming apparatus A is provided with the openable door 13 in a rotatable and movable manner. When the openable door 13 is opened, a guide rail 12 is provided and the cartridge B is mounted into the main assembly of the image forming apparatus A along the guide rails 12.

Then, a driving shaft 14 to be driven by an unshown motor provided in the main assembly of the image forming apparatus A is engaged with a driving force receiving portion 63*a* provided on the cartridge B shown in the right side of FIG. 5. As a result, the photosensitive drum 62 connected with the driving force receiving portion 63*a* is rotated by receiving the driving force from the main assembly of the image forming apparatus A. The charging roller 66 and the developing roller 32 are supplied with electric power (energy) from an unshown electric power supplying portion provided in the main assembly of the image forming apparatus A.

<General Structure of Cartridge>

Figure 4:
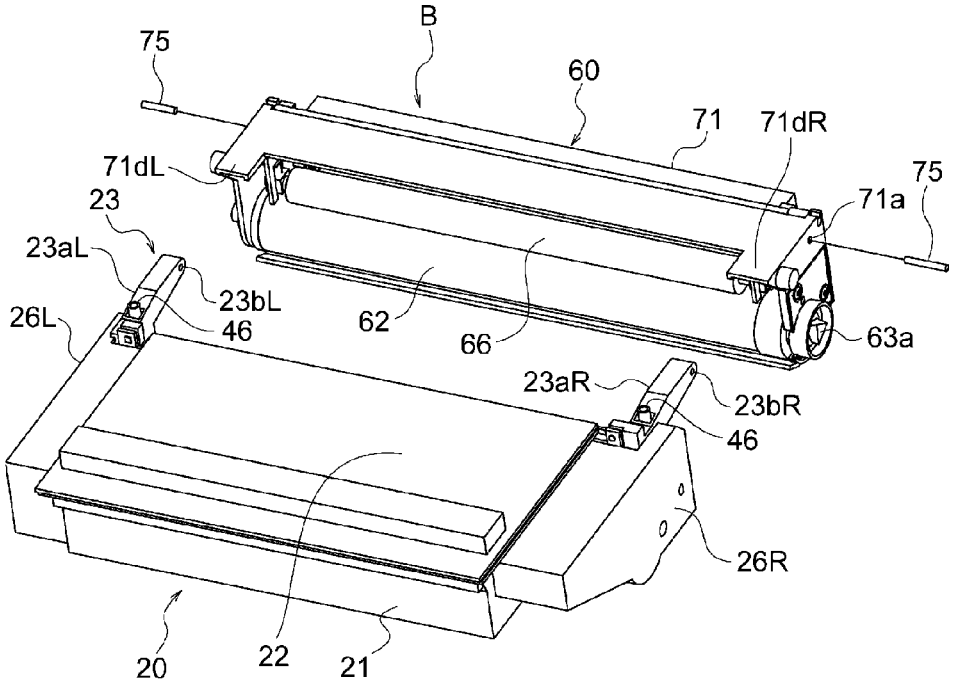
FIG. 4 is an exploded perspective view showing the structure of the process cartridge to which the cartridge according to the present invention in Embodiment 1 is applied.

Next, with respect to FIGS. 3 and 4, a general structure of the cartridge B will be described. FIG. 4 is an exploded perspective view showing a structure of the cartridge B.

The cartridge B is constituted by combining the cleaning unit 60 and the developing unit 20.

The cleaning unit 60 is constituted by a cleaning frame 71, the photosensitive drum 62, the charging roller 66, the cleaning blade 77 and the like. On the other hand, the developing unit 20 includes a toner accommodating container 21 as a frame, a cap (member) 22, a developing (member) container 23, side members 26L and 26R, a developing blade 42, the developing roller 32, the magnet roller 34, the feeding member 43, the a toner discharge hole 103*a* as an opening. Further, the developing unit 20 includes a toner bag 100 as a flexible developer bag which is provided inside the toner accommodating container 21 as the frame and which contains therein the toner 2 as the developer, and includes the toner 2, an urging member 46 and the like.

The cleaning unit 60 and the developing unit 20 are rotationally movably connected with each other by pin-like connecting members 75, so that the cartridge B is constituted. Specifically, at end portions of arm portions 23*a*L and 23*a*R formed at longitudinal end portions of the developing unit 20 (with respect to an axial direction of the developing roller 32), rotation holes 23*b*L and 23*b*R parallel to the axial direction of the developing roller 32 are provided.

Further, at each of longitudinal end portions of the cleaning frame 71, an engaging hole 71*a* for being engaged with the pin-like connecting member 75 is formed. Then, the arms 23*a*L and 23*a*R are aligned with predetermined positions of the cleaning frame 71 and therefore each of the connecting member 75 is inserted into the rotation hole 23*b*L (or 23*b*R) and the engaging hole 71*a*, so that the cleaning unit 60 and the developing unit 20 are rotatably connected about the connecting members 75.

At this time, the urging members 46 mounted at base portions of the arm portions 23*a*L and 23*a*R contact contact portions 71*d*L and 71*d*R, respectively, provided to the cleaning frame 71, so that the urging members 46 urge the developing unit 20, about the connecting members 75 as a rotation center, toward the cleaning unit 60.

As a result, the developing roller 32 shown in FIG. 3 is pressed toward the photosensitive drum 62 with reliability.

Figure 6:
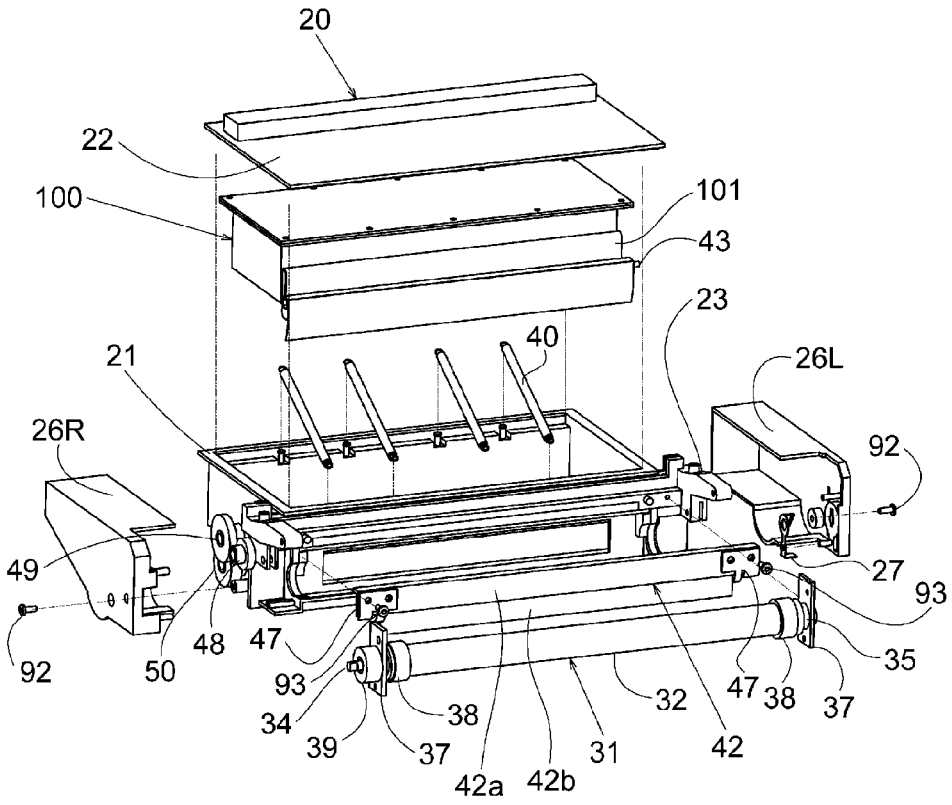
FIG. 6 is an exploded perspective view showing a developing unit to which the cartridge according to the present invention is Embodiment 1 is applied.

Then, by a gap (spacing) holding member 38, shown in FIG. 6, mounted at each of the end portions of the developing roller 32, the developing roller 32 is held with a predetermined gap from the photosensitive drum 62.

<Structure of Cleaning Unit>

Next, with reference to FIG. 5, a structure of the cleaning unit 60 will be described. FIG. 5 is a perspective view for illustrating the structure of the cleaning unit 60. The cleaning blade 77 is consisting of a supporting member 77*a* formed with a metal plate and an elastic member formed of an elastic material such as urethane rubber, and is disposed in a predetermined position with respect to the cleaning frame 71 by fixing the supporting member 77*a* with screws 91 at end portions of the supporting member 77*a*.

The elastic member 77*b* contacts the photosensitive drum 62 to remove the residual toner from the outer peripheral surface of the photosensitive drum 62. The removed residual toner T is stored in the residual toner chamber 71 of the cleaning unit 60 shown in FIG. 3.

Seal members 82-85 shown in FIGS. 3 and 5 are fixed to the cleaning frame 71 in predetermined positions by a double-side tape or the like. The seal member 82 shown in FIG. 3 is provided over the longitudinal direction of the cartridge B to prevent the residual toner T from leaking out from the rear surface side of the supporting member 77*a* of the cleaning blade 77. The seal member 83 shown in FIG. 5 prevents the residual toner T from leaking out from the longitudinal end portions of the elastic member 77*b* of the cleaning blade 77.

The seal member 84 shown in FIG. 5 wipes off a deposited matter such as the toner T on the surface of the photosensitive drum 62 while preventing the leaking out of the residual toner T from the longitudinal end portions of the elastic member 77*b* of the cleaning blade 77. The seal member 85 is provided in contact with the photosensitive drum 62 over the longitudinal direction of the photosensitive drum 62 to prevent the residual toner T from leaking out from an upstream side of the cleaning blade 77 with respect to the rotational direction of the photosensitive drum 62.

An electrode plate 81, urging members 68 and charging roller bearings 67L and 67R shown in FIG. 5 are mounted to the cleaning frame 71. A shaft portion 66*a* of the charging roller 66 is engaged into the charging roller bearings 67L and 67R.

The charging roller 66 is urged against the photosensitive drum 62 by the urging members 68 and is also rotatably supported by the charging roller bearings 67L and 67R. Then, the charging roller 66 is rotated by rotation of the photosensitive drum 62.

Incidentally, the electrode plate 81, the urging members 68 and the charging roller bearings 67L and 67R have electroconductivity. The electrode plate 81 contacts an unshown electric power supplying portion of the main assembly of the image forming apparatus A. These members constitute an electric power supplying path to supply the electric power to the charging roller 66.

The photosensitive drum 62 is integrally connected with flanges 63 and 64 to constitute a photosensitive drum unit 61. As a connecting method, caulking, bonding, welding or the like is used. To the flange 64, an unshown grounding contact or the like is connected. Further, the flange 63 includes a driving force receiving portion 63*a* for receiving the driving force from the main assembly of the image forming apparatus A and a flange gear portion 63*b* for transmitting the driving force to the developing roller 32.

A bearing member 76 is integrally fixed to the cleaning frame 71 with screws 90 in the driving side of the cleaning frame 71, and a drum shaft 78 is press-fitted and fixed into the cleaning frame 71 in the non-driving side of the cleaning frame 71. Further, the bearing member 76 is engaged with the flange 63, and the drum shaft 78 is engaged in a hole 64*a* of the flange 64. As a result, the photosensitive drum unit 61 is rotatably supported by the cleaning frame 71.

A protective member 79 is rotatably supported by the cleaning frame 71 so that the photosensitive drum 62 can be protected (light-blocked) and exposed. An urging member 80 is mounted to a shaft portion 79*a*R of the protective member 79 in the driving side and urges the protective member 79 in a direction of protecting the photosensitive drum 62. A driving-side shaft portion 79*a*L and the non-driving-side shaft portion 79*a*R of the protective member 79 are engaged with bearing portions 71*c*L and 71*c*R of the cleaning frame 71.

<Developing Unit>

Next, a structure of the developing unit 20 will be described with reference to FIGS. 3 and 6. FIG. 6 is an exploded perspective view showing a structure of the developing unit 20.

A developing (device) frame as a frame consisting of the toner accommodating container 21, the cap (member) 22 and the developing container 23 includes the toner chamber 29 in which the toner bag 100 as the developer bag shown in FIG. 3 is accommodated, and includes the toner feeding chamber 28. The toner accommodating container 21, the cap (member) 22 and the developing container 23 are integrally connected with each other by welding or the like.

Tension coil springs 40 as an elastic member for permitting discharge of the toner 2 through the toner discharge hole 103*a* as the opening provided in the toner bag 100 by acting on the toner bag 100 are fixed to the toner accommodating container 21 at ends thereof.

The toner bag 100 contains the toner 2 and is fixed to an end of a seal member 101. The other end of the seal member 101 is fixed to the feeding member 43 functioning as an unsealing means. Further, the toner bag 100 is fixed, at its upper portion, to the cap (member) 22 as the frame, thus being supported swingably.

The feeding member 43 is supported by the toner accommodating container 21 in the non-driving side, and is supported by a feeding gear 50 mounted to the toner accommodating container 21 in the driving side. As a result, the feeding member 43 is rotated in the toner chamber 29 by the rotational drive of the feeding gear 50.

The developing blade 42 is constituted by a supporting member 42*a* formed with a metal plate and an elastic member 42*b* formed of an elastic material such as an urethane rubber, and is fixed together with a cleaning member 47 in a predetermined position relative to the developing container 23 by screws 93.

The elastic member 42*b* contacts the surface of the developing roller 32, and defines a layer thickness of the toner T deposited on the peripheral surface of the developing roller 32 and also imparts triboelectric charges to the toner T.

The cleaning member 47 contacts the surface of the developing roller 32 at each of the longitudinal end portions of the developing roller 32, so that the deposited matter such as the toner T is removed.

A developing roller unit 31 is constituted by the developing roller 32, the magnet roller 34, the flange 35, the gap holding member 38, a bearing member 37, a developing roller gear 39 and the like. From an end portion of the developing roller 32 in the non-driving side, the magnet roller 34 is inserted, and at the end portion, the flange 35 is press-fitted and fixed.

In the flange 35, an unshown electroconductive electrode wire is incorporated, and the electrode wire is contacted to the developing roller 32 and an electrode plate 27. The electrode plate 27 having electroconductivity is fixed on a side member 26L.

The electrode plate 27 contacts and supplies electric power to an unshown electric power supplying portion in the main assembly of the image forming apparatus A, so that a developing bias voltage is applied, to the developing roller 32, from the electric power supplying portion of the main assembly of the image forming apparatus A through the electrode plate 27 and an electrode wire as an electric power supplying path.

The gap holding member 38 is mounted at each of the longitudinal end portions of the developing roller 32. Outside the gap holding member 38, the bearing member 37 is disposed, and in the driving side, the developing roller gear 39 is incorporated outside the bearing member 37. The developing roller 32 is rotatably supported by the bearing member 37 disposed at each of the longitudinal end portions of the developing roller 32.

Gears 48 and 49 as a drive transmission member are rotatably mounted to the developing frame 2. As a result, the driving force received from the driving shaft 14 of the main assembly of the image forming apparatus A shown in FIG. 2 via the driving force receiving portion 63*a* shown in FIG. 5 is transmitted by successive engagement of the flange gear portion 63*b* shown in FIG. 5, and the developing roller gear 39, the gears 48 and 49, and the feeding gear 50 which are shown in FIG. 6. Then, the driving force is transmitted to the developing roller 32 and then is transmitted to the feeding member 43.

The side members 26L and 26R are fixed with screws 92 to the developing frame at the longitudinal end portions. At that time, the bearing members 37 of the predetermined unit 31 are held by the side members 26L and 26R.

<Structure of Toner Bag>

Figure 7:
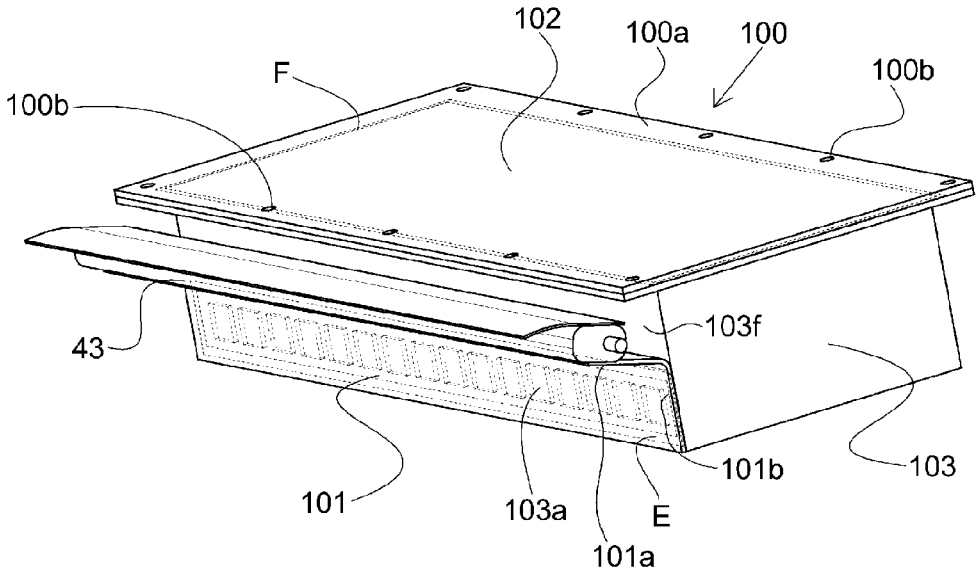
FIG. 7 is a perspective illustration showing a structure of a developing bag applicable to the cartridge according to the present invention.
Figure 8:
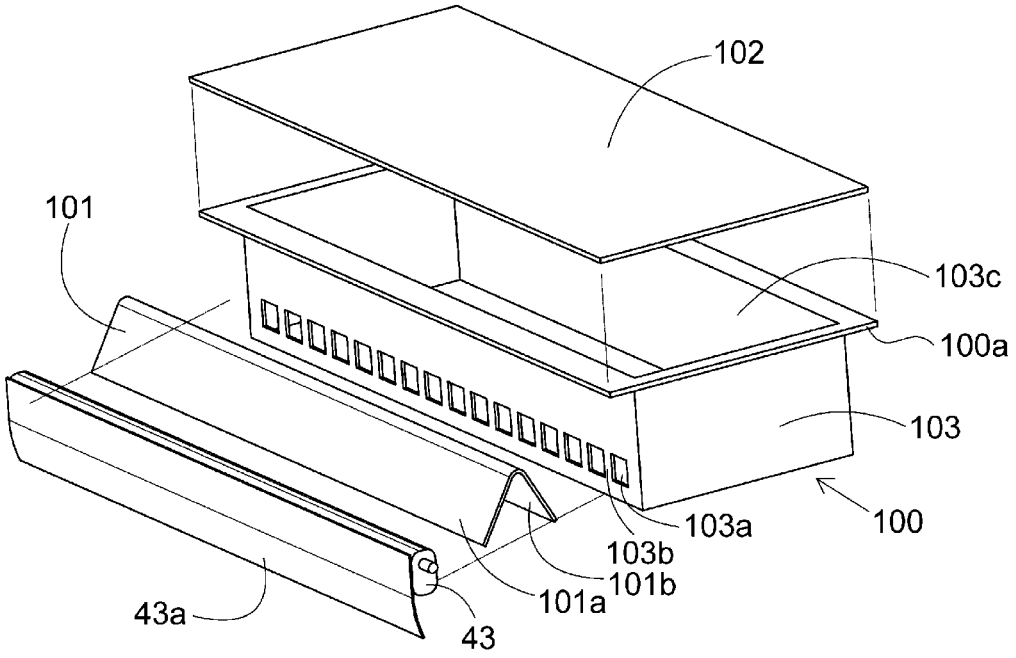
FIG. 8 is an exploded perspective view showing the structure of the developer bag applicable to the cartridge according to the present invention.

Next, a structure of the toner bag 100 will be described with reference to FIGS. 7 and 8. FIG. 7 is a perspective view of the toner bag 100 and the feeding member 43 after assembling. FIG. 8 is an exploded perspective view for illustrating a structure of the toner bag 100.

As shown in FIG. 8, the toner bag 100 is constituted by the seal member 102, the toner accommodating member 103 and the sealing member 101.

The toner accommodating member 103 is a member, formed of a flexible sheet-like material, prepared by vacuum molding, air-pressure molding, press molding or the like, and is provided with the toner discharge holes 103*a* as the opening for permitting discharge of the accommodated toner T. The toner discharge holes 103*a* are partitioned by a plurality of connecting portions 103*b* provided with a predetermined pitch along the longitudinal direction of the toner accommodating member 103.

The sealing member 101 is provided with the sealing portion 101*b* for covering the toner discharge holes 103*a* of the toner accommodating member 103 and is provided with the fixing portion 101*a* to be fixed on the feeding member 43 functioning as the unsealing means.

As shown in FIG. 7, the sealing portion 101*b* of the sealing member 101 is (thermally) welded so as to cover a whole of the toner discharge holes 103*a* of the toner accommodating member 103, thus sealing the toner discharge holes 103*a*. A thermally welded shape of the sealing portion 101*b* of the sealing member 101 is shown by E in FIG. 7.

In this embodiment, as a material for the sealing member 101, a laminate material having a special sealant layer which exhibits an easy peeling property (easy-to-peel property) is applied. The easy peeling property is, e.g., such that peeling strength is about 3N/15 mm to about 10N/15 mm in testing methods for heat sealed flexible package according to JIS-Z0238. Further, as a material for the toner accommodating member 103, a flexible material which is weldable with the special sealant layer is applied, so that it is possible to provide the easy peeling property at the thermal welding portion.

The toner discharge holes 103*a* of the toner accommodating member 103 are sealed by the sealing portion 101*b* of the sealing member 101, and thereafter the toner 2 is filled in the toner accommodating member 103 through an opening 103*c* shown in FIG. 8. When the toner 2 is filled, a known auger-type filling device is used, but a filling method (means) having a similar function may also be used.

The seal member 102 is a flexible sheet member. The seal member 102 is provided with minute holes through which air is permeable. The toner T is filled in the toner accommodating member 103 through the opening 103*c* shown in FIG. 8. Thereafter, a peripheral edge portion of the seal member 102 is thermally welded with a flange portion 100*a* provided at a periphery of the opening 103*c* of the toner accommodating member 103 so as to seal the opening 103*c* of the toner accommodating member 103. A thermally welded shape of the seal member 102 is shown by F in FIG. 7.

As described above, the toner 2 is contained in the toner bag 100, the flange portion 100*a* provided at the periphery of the toner bag 100 is provided with a plurality of fixing holes 100*b*.

On the other hand, the fixing portion 101*a* of the sealing member 101 is fixed to the feeding member 43. As a fixing method thereof, it is possible to use a method, other than the thermal welding, the ultrasonic welding, pseudo bonding, such as locking by hooking using a hole and a projection.

<Accommodating Structure of Elastic Member and Toner Bag in Developing Frame>

Next, with reference to FIGS. 6, 9 and 13, an accommodating structure of the toner bag 100 in the developing frame will be described. Parts (a) and (b) of FIG. 9 exploded are perspective views for illustrating a fixing method between the cap (member) 22 and the toner bag 100. Part (c) of FIG. 9 is an exploded perspective view for illustrating a fixing method of the tension coil springs 40 to the toner accommodating container 21.

First, the tension coil springs 40 will be described. As shown in (c) of FIG. 9, each of the tension coil springs 40 is extended from a free state, and then engaging portions provided at end portions of the tension coil spring 40 are passed through a fixing boss 21*a* provided inside a rear surface plate 21*f* of the toner accommodating container 21 and projected from a top portion of the rear surface plate 21*f* and a fixing boss 21*c* provided inside a bottom plate 21*g* in a front surface plate 21*e* side and projected from the bottom plate 21*g*.

Thereafter, ends of the fixing bosses 21*a* and 21*c* are heated and melted to be deformed, so that the tension coil spring 40 is fixed to the toner accommodating container 21. As a result, the tension coil spring 40 is retained by end portions 21*b* and 21*d* of the deformed fixing bosses 21*a* and 21*c* each made larger in diameter than an inner diameter of a ring-like engaging portion provided at each of the end portions of the tension coil spring 40.

As a result, as shown in FIG. 3, the tension coil springs 40 support a bottom surface 103*d* of the toner accommodating bag 103 of the toner bag 100 so that the bottom surface 103*d* is tilted relative to a horizontal surface h by a predetermined tilt (inclination) angle θ in a state in which a side where the toner discharge holes 103*a* (openings) of the toner bag 100 are provided is positioned at a lower portion.

In this embodiment, the plurality of tension coil springs 40 are, as shown in (c) of FIG. 9 and (a) and (b) of FIG. 13, disposed in the toner accommodating container 21 (in the frame) with respect to a direction crossing (perpendicular to) the longitudinal direction of the cartridge B.

Next, the accommodating structure of the toner bag 100 will be described. As shown in (a) of FIG. 9, the plurality of fixing bosses 22*a* provided so as to be projected from the lower surface of the cap (member) 22 are inserted into the plurality of fixing holes 100*b* provided in the flange portion 100*a* provided at an outer peripheral edge of the toner bag 100. Thereafter, as shown in (b) of FIG. 9, the end portions of the fixing bosses 22*a* are deformed by being heated and melted. As a result, the fixing bosses 22*a* are prevented from being disengaged from the fixing holes 100*b* by the end portions 22*b* each deformed and extended so as to have a diameter larger than a diameter of the associated fixing hole 100*b*. In this way, the developer bag 100 is fixed at its upper portion to the cap (member) 22.

The fixing method between the cap 22 and the toner bag 100 is not limited to the above-described method in this embodiment but may also be a method, such as the (thermal) welding, the bonding, the locking by hooking using an engaging portion consisting of a hole and a projection.

In this way, after the upper end of the toner bag 100 is fixed to the cap 22, as shown in FIG. 6, in the toner accommodating container 21, the toner bag 100 is accommodated so that the bottom surface of the toner bag 100 is supported by the tension coil springs 40.

The tension coil springs 40 in this embodiment are extended from a free state by contact with the toner bag 100, and elastic energy accumulated by the extension acts on the toner bag 100, so that the toner 2 is discharged through the toner discharge hole 103*a* formed in the toner bag 100.

<Setting of Tension Coil Spring>

Next, with reference to FIG. 13, setting of a spring constant of the tension coil springs 40 will be described. Parts (a) and (b) of FIG. 13 are schematic views each showing a state in which the tension coil springs 40 act on the toner bag 100. Part (c) of FIG. 13 is a graph showing setting of spring constants K of the tension coil springs 40.

As shown in (a) of FIG. 13, in the case where all of the spring constants K of the tension coil springs 40 are set at the same value, when an amount of the toner 2 in the toner bag 100 is large, the toner bag 100 is flexed at a central portion thereof by the self-weight thereof. In order to discharge the toner 2 in the toner bag 100, the toner bag 100 may desirably be vibrated by the feeding member 43. For that purpose, there is a need to provide a gap X between the upper surface of the bottom plate 21*d* of the toner accommodating container 21 and the lower ends of the tension coil springs 40 for supporting the lower surface of the toner bag 100.

Therefore, in this embodiment, as shown in (c) of FIG. 13, spring constants Kb and Kc of central tension coil springs 40*b* and 40*c* with respect to the longitudinal direction (left-right direction in FIG. 13) of the cartridge B are set as follows. That is, the spring constants Kb and Kc are selected and set so as to be larger than spring constants Ka and Kd of end portion tension coil springs 40*a* and 40*d* with respect to the longitudinal direction of the cartridge B.

By setting the spring constants K in such a manner, a force T1 for pushing and raising the bottom surface of the toner bag 100 by each of the central portion tension coil springs 40*b* and 40*c* is larger than a force T2 for pushing and raising the bottom surface of the toner bag 100 by each of the end portion tension coil springs 40*a* and 40*d*.

As a result, even in the case where the amount of the toner in the toner bag 100 is large, as shown in (b) of FIG. 13, the bottom surface of the toner bag 100 can be supported in a flat state without flexure of the toner bag 100 at the central portion.

The bottom surface of the toner bag 100 is supported in the flat state. As a result, it is possible to provide the gap X, necessary to satisfactorily permit the discharge of the toner 2, between the upper surface of the bottom plate 21*d* of the toner accommodating container 21 and the lower end of the tension coil springs 40 for supporting the lower surface of the toner bag 100. As a result, it becomes possible to efficiently provide the gap X without upsizing the cartridge B.

Further, in a state in which the amount of the toner 2 in the toner bag 100 is small ("TONER low" in (c) of FIG. 13), as shown in (b) of FIG. 13, a force T1 for pushing and raising the bottom surface of the toner bag 100 at the longitudinal central portions of the cartridge B and a force T2 for pushing and raising the bottom surface of the toner bag 100 at the longitudinal end portions of the cartridge B are substantially equal to each other. The spring constants Ka to Kd of the tension coil springs 40*a* to 40*d* are selected in advance so as to provide a force T3 for pushing and raising the bottom surface of the toner bag 100. As a result, even when the self-weight of the toner 2 is small, the bottom surface of the toner bag 100 can be maintained in the flat state.

By setting the tension coil springs 40 in the above-described manner, even in the case where the amount of the toner 2 in the toner bag 100 is increased, it becomes possible to efficiently discharge the toner 2 in the toner bag 100 without upsizing the cartridge B.

In recent years, from the viewpoint of recycle, lifetime extension of the cartridge B is desired. For the purpose of the lifetime extension, when the amount of the toner in the toner bag 100 is increased, by the self-weight of the toner 2, as shown in (a) of FIG. 13, the flexible toner bag 100 sags at the central portion.

Therefore, in this embodiment, the bottom surface of the toner bag 100 is surfaced by the tension coil springs for pushing and raising the toner bag 100. The feeding member 43 periodically acts on the toner bag 100. As a result, the feeding member 43 periodically acts on the tension coil springs 40 via the toner bag 100.

In a constitution in which the toner 2 is discharged by stirring the toner 2 by the feeding member 43, there is a need to vibrate the toner bag 100 by stirring the toner 2 by the feeding member 43. For this reason, there is a need to provide the gap X between the lower surface of the toner bag 100 and the upper surface of the bottom plate 21*d* of the toner accommodating container 21. In order to provide the gap X, the bottom plate 21*g* of the toner accommodating container 21 is required to be formed along the central portion where the toner bag 100 sags, and therefore the cartridge B is increased in size.

According to this embodiment described above, without upsizing the cartridge B, the toner 2 in the flexible toner bag 100 is discharged satisfactorily, so that the amount of the remaining toner 2 can be made small.

<Unsealing Operation of Toner Bag>

Next, with reference to (a) to (c) of FIG. 10, an unsealing operation of the toner bag 100 will be described. Parts (a), (b) and (c) of FIG. 10 are sectional illustrations showing state of the developing unit 20 before, during and after the unsealing, respectively.

The toner bag 100, the seal member 101 and the feeding member 43 functioning as the unsealing means are accommodated in the toner chamber 29 of the developing unit 20.

The tension coil springs 40 are deformed in a substantially dogleg shape by the self-weight of the toner 2 in the toner bag 100 while contacting the bottom surface 103*d* of the toner accommodating bag 103 and the rear surface 103*e* opposite from the toner discharge hole 103*a*.

When an unused cartridge B is mounted to the main assembly of the image forming apparatus A, the driving force is transmitted from the main assembly of the image forming apparatus A, the feeding member 43 is rotated, from the state before the unsealing as shown in (a) of FIG. 10, in a rotational direction indicated by an arrow G in (a) of FIG. 10.

At this time, as shown in (b) of FIG. 10, the sealing member 101 is wound up abound the feeding member 43, and at the same time, the welded portion between the sealing portion 101*b* and the toner accommodating member 103 is gradually peeled, so that the toner discharge holes 103*a* are started to be exposed.

Further, when the driving force is transmitted from the main assembly of the image forming apparatus A, as shown in (c) of FIG. 10, the sealing member 101 is completely wound up around the feeding member 43, so that the toner discharge holes 103*a* are completely exposed. Thus, the toner T is subjected to the action of gravitation and therefore is discharged into the toner chamber 29 via the toner discharge holes 103*a*.

Above the toner discharge hole 103*a* in the toner bag 100, as shown in (c) of FIG. 10, a space S is created correspondingly to the amount of the discharged toner 2. An angle formed between a boundary line SL, between the space S and the toner 2, and the horizontal surface h is substantially equal to an angle of repose peculiar to the toner 2. Incidentally, the angle of repose refers to an angle of an inclined surface where the toner 2 in the toner bag 100 is stably maintained without being spontaneously collapsed.

<Toner Discharging Operation>

Next, with reference to FIGS. 11 and 12, a discharging operation of the toner 2 from the toner bag 100 will be described. Parts (a) and (b) of FIG. 11 are sectional illustrations of the developing unit 20 for illustrating a state of toner discharge in a state in which the remaining amount of the toner bag 100 immediately after the unsealing of the seal member 101 is large. Part (a) of FIG. 12 is a sectional illustration of the developing unit 20 for illustrating a state of the toner discharge in a medium remaining amount of the toner in the toner bag 100. Part (b) of FIG. 12 is a sectional illustration of the developing unit 20 in a state of the toner discharge in a small remaining amount of the toner in the toner bag 100.

First, with reference to (a) of FIG. 20, the toner discharge in the state in which the remaining toner amount is large will be described.

The feeding member 43 includes a sheet member 43*a* as an acting member. The feeding member 43 is formed of a rigid material such as polystyrene (PS), polycarbonate (PC) or polyoxymethylene (POM).

The sheet member 43*a* is formed of a sheet-like flexible material such as polyphenylene sulfide (PPS), polycarbonate (PC) or polyethylene terephthalate (PET), and performs stirring and feeding of the toner 2.

A stirring diameter of the sheet member 43*a* is represented by r1 in (a) of FIG. 11. The feeding member 43 is rotated in the arrow G direction in (a) of FIG. 11, so that the sheet member 43*a* feeds the toner 2 within a region of the stirring radius r1 to the toner feeding (supplying) chamber 28.

When the feeding member 43 is further rotated in the arrow G direction, the sheet member 43*a* and the seal member 101 contact the connecting portion 103*b* of the toner accommodating bag 103 at the front surface 103*f*. As a result, the toner accommodating bag 103 receives an external force with respect to an arrow Q direction in (b) of FIG. 11. The tension coil springs 40 contacting the toner accommodating bag 103 are displaced in arrow M1 and N1 directions in (b) of FIG. 11.

When the feeding member 43 is further rotated in the arrow G direction to space the sheet member 43*a* and the seal member 101 from the connecting portion 103*b* at the front surface 103*f* of the toner accommodating bag 103, the tension coil springs 40 are displaced in arrow M2 and N2 directions in (b) of FIG. 11. Incidentally, the arrow M1 and M2 directions are opposite directions, and the arrow N1 and N2 directions are opposite directions.

The tension coil springs 40 are constituted by an elastic member, and therefore after the external force is removed, vibration is induced between the arrow M1 and M2 directions and between the arrow N1 and N2 directions. By the vibration of the tension coil springs 40, also the bottom surface 103*d* and the rear surface 103*e* of the toner accommodating bag 103 *f* the toner bag 100 are vibrated, so that the toner 2 in the neighborhood of the inside of the surfaces 103*d* and 103*e* is subjected to vibration and thus the toner 2 is easily loosened.

When the feeding member 43 is continuously rotated in the arrow G direction in FIG. 11, the toner 2 in the toner bag 100 is discharged through the toner discharge holes 103*a* by the self-weight of the toner 2 and the vibration of the tension coil springs 40. Further, the toner 2 is fed from the toner chamber 29 to the toner feeding chamber 28 and thus filled in the toner chamber 29 and the toner feeding chamber 28.

Next, with reference to (a) of FIG. 12, the state of the toner discharge in the medium remaining amount of the toner 2 in the toner bag 100 will be described.

The toner 2 in the toner bag 100 is discharged through the toner discharge holes 103*a* by the self-weight of the toner 2 and the vibration of the tension coil springs 40. Then, the toner 2 fed from the toner chamber 29 to the toner feeding chamber 28 is, after being carried on the surface of the developing roller 32, transferred onto the photosensitive drum 62 shown in FIG. 3, so that the electrostatic latent image is visualized, with the toner 2, as the toner image on the surface of the photosensitive drum 62.

As a result, the toner 2 in the toner chamber 29 and the toner feeding chamber 28 is consumed, and therefore the toner 2 in an amount compensating for the consumed amount of the toner 2 is discharged through the toner discharge holes 103*a* of the toner bag 100, so that the remaining amount of the toner 2 in the toner bag 100 is gradually decreased.

When the toner 2 in the toner bag 100 is decreased in amount, the external force due to the self-weight of the toner 2 acting on the tension coil springs 40 is decreased, and therefore the tension coil springs 40 are compressed so as to balance with the decreased external force.

When the tension coil springs 40 are compressed, a degree of flexure of the dogleg shape shown in (a) of FIG. 12 and thus the dogleg shape more approaches a straight shape, and therefore the bottom surface 103*d* of the toner accommodating bag 103 of the toner bag 100, so that the tilt (inclination) angle θ based on the horizontal surface h becomes large. When a tilt angle θ1 between the horizontal surface h and the bottom surface 103*d* of the toner accommodating bag 103 of the toner bag 100 shown in (b) of FIG. 11 and a tilt angle θ2 between the horizontal surface h and the bottom surface 103*d* of the toner accommodating bag 103 of the toner bag 100 shown in (a) of FIG. 12 are compared, $\theta 1<\theta 2$ is satisfied.

Further, the bottom surface 103*d* of the toner accommodating bag 103 of the toner bag 100 is raised by the tension coil springs 40, whereby the rear surface 103*e* of the toner accommodating bag 103 is loosened and then is flexed toward the inside of the toner bag 100.

Further, when the amount of the toner 2 in the toner bag 100 is decreased, an acting force on the tension coil springs 40 generated by periodical contact of the sheet member 43*a*, rotated integrally with the feeding member 43, and the seal member 101 with the front surface 103*f* of the toner accommodating bag 103 of the toner bag 100 is increased. Then, the arrow Q direction and the arrow M1 and M2 directions shown in FIG. 12 are made close to a parallel state.

Based on these two points described above, an amount of the displacement (amplitude of vibration) of the tension coil springs 40 in the arrow M1 and M2 directions in FIG. 12 is increased, so that a toner loosening effect in the toner bag 100 is improved.

Next, with reference to (b) of FIG. 12, a state of the toner discharge in the small remaining amount in the toner bag 100 will be described.

When the toner consumption further advances, the amount of the toner 2 in the toner bag 100 is decreased and thus the external force, due to the self-weight of the toner 2, acting on the tension coil springs 40 is decreased, and therefore the tension coil springs 40 are compressed until a compressed degree balances with the decreased external force.

As shown in (b) of FIG. 12, when the remaining amount of the toner 2 in the toner bag 100 becomes small, the tension coil springs 40 are compressed until their shapes reach a substantially straight (rectilinear) shape. The bottom surface 103*d* of the toner bag 100 is further raised, so that a tilt angle θ3 of the bottom surface 103*d* from the horizontal surface h is further increased ($\theta 1<\theta 2<\theta 3$).

As shown in (b) of FIG. 12, the bottom surface 103*d* and the rear surface 103*e* of the toner accommodating bag 103 of the toner bag 100 are flexed in a substantially S-shape so as to be projected toward the inside of the toner bag 100.

Further, when the toner 2 in the toner bag 100 is decreased in remaining amount, as described above, the displacement amount (amplitude of vibration) of the bottom surface 103*d* of the toner accommodating bag 103 of the toner bag 100 in the arrow M1 and M2 directions is increased, so that the toner loosening effect in the toner bag 100 is improved.

When the toner consumption further advances from the state shown in (b) of FIG. 12, the toner 2 in the toner bag 100 is loosened by the vibration of the tension coil springs 40 in the arrow M1 and M2 directions in (b) of FIG. 12. At the same time, the toner 2 deposited on the bottom surface 103*d* of the toner accommodating bag 103 in an inner surface side of the toner bag 100 is peeled off from the inner bottom surface 103*d*. As a result, the toner 2 in the toner bag 100 can be discharged in a substantially whole amount.

As described above, according to the cartridge B in this embodiment, the toner 2 in the toner bag 100 can be satisfactorily discharged through the toner discharge holes 103*a*, so that the remaining amount of the toner 2 in the toner bag 100 can be decreased.

Further, as the acting member periodically acting on the tension coil springs 40, used as the elastic member, via the toner bag 100, the sheet member 43*a* rotated integrally with the feeding member 43 is used. As a result, depending on the remaining amount of the toner 2 in the toner bag 100, the toner bag 100 can be raised by the tension coil springs 40 and at the same time, can be vibrated.

As a result, there is a constitution in which the tilt angle θ enough to drop the toner 2 by the self-weight of the toner 2 is not provided by the bottom surface 103*d* of the toner accommodating bag 103 of the toner bag 100. Also in the constitution, elastic energy accumulated by the extension of the tension coil springs 40 acts on the bottom surface 103*d* and the rear surface 103*e* of the toner accommodating bag 103 of the toner bag 100. Thus, the toner 2 in the toner bag 100 can be discharged satisfactorily, so that it is possible to decrease the remaining amount of the toner 2 in the toner bag 100.

Incidentally, in this embodiment, as the elastic member, the tension coil springs 40 are used. However, the present invention is not limited thereto, and it is also possible to use a member having elasticity. For example, as the material for the elastic member, a rubber material such as natural rubber, urethane rubber or butadiene rubber may also be used. Further, as a shape of the elastic member, it is also possible to use a flat plate shape, a tube shape and a cylindrical shape.

[Embodiment 2]

Structure of a cartridge, a developing cartridge, a process cartridge and an image forming apparatus according to the present invention in Embodiment 2 will be described with reference to FIGS. 14 to 17. Incidentally, constituent elements which are the same as those in Embodiment 1 are represented by the same reference numerals or symbols and will be omitted from description.

In Embodiment 1, the feeding member 43 as the acting member is constituted in the elongated circular shape in cross section, and the feeding member 43 itself is spaced from the front surface 103*f* of the toner accommodating bag 103 of the toner bag 100. Further, the constitution in which the seal member 101 and the sheet member 43*a* which are fixed to the feeding member 43 at one end portion periodically contact the connecting portion 103*b* at the front surface 103*f* of the toner accommodating bag 103 with the rotation of the feeding member 43 was employed.

In this embodiment, as shown in FIG. 14, a constitution in which the feeding member 43 is provided with an urging portion 43*b* at an outer peripheral end portion thereof and with rotation of the feeding member 43, also the urging portion 43*b* periodically urges, together with the feeding portion 43*a*, the connecting portion 103*b* at the front surface 103*f* of the toner accommodating bag 103 was employed. As a result, the feeding member 43 further positively acts on the toner 2 in the toner bag 100, so that a toner discharging property is improved.

Parts (a) to (c) of FIG. 14 are sectional illustrations of a developing unit 20 for illustrating discharge of the toner 2 remaining in the toner bag 100. Parts (a) to (c) of FIG. 14 show a state in which the feeding member 43 is rotated in the rotational direction indicated by the arrow G in FIG. 14. Part (a) of FIG. 14 shows the state at the moment when the sheet member 43*a*, urged by the urging portion 43*b*, of the feeding member 43 contacts the front surface 103*f* of the toner accommodating member 103 of the toner bag 100. Thereafter, when the feeding member 43 is rotated in the arrow G direction in FIG. 14, as shown in (b) of FIG. 14, the urging portion 43*b* as the acting member reaches a region where the urging portion 43*b* interferes with the front surface 103*f* of the toner accommodating bag 103 of the toner bag 100. Incidentally, a rotation radius of an end of the urging portion 43*b* is represented by r2 in FIG. 14.

At this time, the toner bag 100 receives an urging force from the urging portion 43*b* and the sheet member 43*a*. Both of the sheet member 43*a* and the urging portion 43*b* apply the urging force to the front surface 103*f* of the toner accommodating bag 103 of the toner bag 100. Here, the urging force of the urging portion 43*b* having rigidity is larger than the urging force of the sheet member 43*a* having a sheet shape, and therefore in this embodiment, the urging portion 43*b* is defined as a principal acting member.

Here, the flexible toner bag 100 is deformed and at the same time, the lower portion thereof and the toner 2 inside the toner bag 100 are moved in an arrow H direction in FIG. 14. At the moment when the toner bag 100 is displaced in the arrow H direction in FIG. 14 to the maximum, a speed becomes "0 (zero)", and at the same time, acceleration becomes maximum with respect to an arrow J direction in FIG. 14. At this time, the force of inertia such that the toner 2 in the toner bag 100 is moved in the arrow H direction in FIG. 14 relative to the toner bag 100 acts on the toner 2 in the toner bag 100. As a result, the toner 2 in the toner bag 100 is loosened.

When the feeding member 43 is further rotated in the arrow G direction in FIG. 14, the urging portion 43*b* is spaced from the front surface 103*f* of the toner accommodating bag 103 of the toner bag 100. Immediately thereafter, the urging force of the urging portion 43*b* toward the toner bag 100 is eliminated. Then, the lower portion of the toner bag 100 and the toner 2 inside the toner bag 100 are moved in the arrow J direction in (b) of FIG. 14 by the self-weight of the toner 2 in the toner bag 100 and a restoring force of the tension coil springs 40.

Thereafter, as shown in (c) of FIG. 14, the toner bag 100 is quickly decreased in speed by collisions with a receiving portion 43*c* of the feeding member 43 and is stopped in a position preceding the position where the urging portion 43*b* urges the toner bag 100. At this time, by the quick decrease in speed, the force of inertia that the toner 2 in the toner bag 100 is moved in the arrow J direction in (c) of FIG. 14 acts on the toner 2 in the toner bag 100.

The toner T in the toner bag 100 is gradually moved toward the toner discharge holes 103*a* by gravitation and the force in the arrow J direction in (c) of FIG. 14 due to the force of inertia.

The present inventors measured displacement, speed and acceleration of this swing motion of the toner bag 100 in an experiment to confirm that the above-described force of inertia acts on the toner 2.

FIG. 15 includes graphs showing results of the experiment of the behavior of the toner bag 100. Incidentally, measurement was made by measuring the displacement of a measuring portion 100*d* of the toner bag 100 shown in FIG. 14 by using a laser displacement gage. The graphs of time progression of the displacement, the speed and the acceleration of the toner bag 100 are shown in FIG. 15.

In the graphs shown in FIG. 15, the ordinate represents the displacement, the speed and the acceleration from the above to the below, and the abscissa represents the time. In FIG. 15, a swing start time of the toner bag 100 is t1, a swing release time is t2, and a complete stop time is t3. Further, in FIG. 15, the ordinate represents the arrow J direction (FIG. 14) directed upward and the arrow H direction (FIG. 14) directed downward.

As is understood from graphs of FIG. 15, respectively, the toner bag 100 is moved acceleratedly from the swing start time t1, and before and after the swing release time t2, the acceleration in the arrow J direction in FIG. 14 is generated. At this time, the force of inertia acts on the toner 2 in the toner bag 100 in the arrow H direction in FIG. 14. Further, before the complete stop time t3, the acceleration in the arrow J and H directions in FIG. 14 is generated. At this time, the force of inertia acts on the toner 2 in the toner bag 100 in the arrow H and J directions in FIG. 14.

In this way, by the experiment, as described above, the force of inertia acting on the toner 2 after the sheet member 43*a* was spaced from the toner bag 100 was able to be confirmed.

As described above, the toner bag 100 causes the swing motion by urging, spacing (separation) and collision between the toner bag 100 and the sheet member 43*a*. With the swing motion, the toner 2 in the developer bag 100 is satisfactorily loosen, and thereafter is moved toward the toner discharge holes 103*a*.

The urging, spacing and collision between the toner bag 100 and the urging portion 43*b* as the acting member are periodically repeated during the transmission of the driving force to the process cartridge B. The above-described swing motion and the vibration successively act on the toner 2, so that the toner 2 is satisfactorily discharged through the toner discharge holes 103*a*.

FIG. 16 is a perspective view showing the developing unit 20. For convenience of explanation, a part of elements of the developing unit 20 is omitted. As shown in FIG. 16, at each of side surfaces of the toner bag 100, a side space 112 is provided with respect to the toner accommodating container 21. Similarly, at a lower portion and a rear portion of the toner bag 100, a lower space 110 and a rear space 111 are provided, respectively, with respect to the toner accommodating container 21. In the lower space 110 and the rear space 111, the tension coil springs 40 are disposed.

As a result, obstruction of the swing and the vibration of the toner bag 100 by friction of the toner bag 100 and the tension coil springs 40 with the toner accommodating container 21 can be eliminated. Therefore, a toner 2-discharging effect by the swing and the vibration of the toner bag 100 can be satisfactorily achieved.

Thus, the toner 2 discharged from the toner bag 100 is fed to the toner feeding chamber 28 by the feeding member 43.

In this embodiment, the acting member is constituted by the feeding member 43 and therefore the swing of the toner bag 100 and the feeding of the toner 2 can be performed by the same member, thus being suitable.

By using the urging portion 43*b* as the acting member periodically acting on the tension coil springs 40, an effect of applying vibration to the toner bag 100 is increased.

As described above, also in a constitution in which the bottom surface of the toner accommodating container 21 has no inclination enough to cause drop of the toner 2 by the self-weight, the toner 2 in the toner bag 100 can be discharged satisfactorily, so that it is possible to decrease the amount of the remaining toner in the toner bag 100. Other constitutions are the same as those in Embodiment 1, and a similar effect can be obtained.

Parts (a) and (b) of FIG. 17 are sectional illustrations for illustrating a state in which a crease formed at a rear surface portion in a position opposite from the toner discharge holes 103*a* of the toner bag 100 is projected toward a space in which the toner 2 is accommodated.

Parts (a) and (b) of FIG. 17 are sectional views for illustrating a state of deformation of the toner accommodating bag 103 in Embodiments 1 and 2 described above. Incidentally, for convenience of explanation, description will be made by using only a cross section of the toner accommodating bag 103.

In this embodiment, deformation of the rear surface 103*e* of the toner accommodating container 103 in the toner bag 100 is devised to improve the toner discharging property.

In (a) and (b) of FIG. 17, a solid line represents the cross section of the toner accommodating bag 103 before the deformation. Further, a broken line represents the cross section of the toner accommodating bag 103 in a state in which consumption of the toner 2 is substantially ended and the bottom surface 103*d* and the rear surface 103*e* of the toner accommodating bag 103 are raised in the arrow Z direction in (a) of FIG. 17 by the tension coil springs 40.

As indicated by the broken line showing the state after the deformation, the rear surface 103*e* of the toner accommodating bag 103 is flexed in an arcuate shape at a portion where an upper surface 103*e*1 and a lower surface 103*e*2 are connected with each other. When the rear surface 103*e* is flexed in the arcuate shape, a restoring force for restoring the shape of the toner accommodating bag 103 from the arcuate shape to an original rectilinear (line) shape is generated with respect to an up-down (vertical) direction.

The downward restoring force is required so that a spring force of the tension coil springs 40 is designed to be strong in order to resist against the direction in which the tension coil springs 40 raise the toner bag 100 in the arrow Z direction in (a) of FIG. 17.

Further, in the case where a user demounts the cartridge B from the main assembly of the image forming apparatus A and then handles the cartridge B so that the rear surface 103*e* is directed downward in the vertical direction, the toner 2 is deposited on the upper surface 103*e*1. However, the upper surface 103*e*1 is raised in the arrow Z direction in (a) of FIG. 17 by the restoring force, and therefore the deposited toner 2 is not readily dropped.

Therefore, (b) of FIG. 17 shows an example in which this point is improved. In (b) of FIG. 17, the solid line and the broken line represents the same states as those in (a) of FIG. 17.

As shown in (b) of FIG. 17, the rear surface 103*e* of the toner accommodating bag 103 is provided with a crease (fold) 103*g*. The crease 103*g* is provided so as to project toward the space in which the toner 2 is accommodated.

Further, in (b) of FIG. 17, when a deformation radius r3 of a lower edge line 103*i* and a deformation radius r4 of an upper edge line 103*h* are compared, r3<r4 is satisfied, and therefore a position of the crease 103*g* is set at a position closer to the lower edge line 103*i* than a midpoint of the rear surface 10*e*.

In this embodiment, in the case where a length from the lower edge line 103*i* to the crease 103*g* is L2 and a length from the upper edge line 103*h* to the crease 103*g* is L1, these lengths are set so that L2: L1 nearly equals to 7:12.

By the action of the tension coil springs 40, when the toner accommodating bag 103 is raised, as shown in (b) of FIG. 17, the crease 103*g* is flexed inward, so that the toner accommodating bag 103 is deformed so that the upper surface 103*e*1 and the lower surface 103*e*2 substantially contact each other.

As described above, by providing the crease 103*g* so as to project toward the inside of the toner bag 100, the rear surface 103*e* of the toner accommodating bag 103 is easily flexed via the crease 103*g*, and therefore the restoring force of the rear surface 103*e* is decreased. As a result, there is no need to set the spring force of the tension coil springs 40 at a large value more than necessary.

Further, the position of the crease 103*g* is made closer to the lower edge line 103*i* than the midpoint of the rear surface 103*e*, whereby the tilt angle of the upper surface 103*e*1 after the deformation can be caused to approach the same level as the tilt angle of the bottom surface 103*d*. As a result, even when the toner 2 is deposited on the upper surface 103*e*1 by the handling by the user, the toner 2 can slide and drop along the inclined surface, with the result that the toner 2 can be satisfactorily discharged to decrease the remaining toner amount in the toner bag 100.

[Embodiment 3]

Structure of a cartridge, a developing cartridge, a process cartridge and an image forming apparatus according to the present invention in Embodiment 3 will be described with reference to FIGS. 18 to 21. Incidentally, constituent elements which are the same as those in Embodiments 1 and 2 are represented by the same reference numerals or symbols and will be omitted from description.

In this embodiment, tension coil springs 201 and 202 as the elastic member are provided inside the toner accommodating bag 103 as the frame in substantially parallel with each other with respect to the longitudinal direction (left-right direction in FIG. 20) of the cartridge B at different positions in height. As a result, the tension coil springs 201 and 202 positively act on the toner 2 in the toner bag 100 to improve the toner discharging property.

FIG. 18 is an exploded perspective view for illustrating fixing positions of the tension coil springs 201 and 202 in the toner accommodating container 21. Parts (a) and (b) of FIG. 19 are sectional views of the developing unit 20 for illustrating a positional relationship between the toner bag 100 and the tension coil springs 201 and 202.

Parts (a) and (b) of FIG. 20 are plan views of the developing unit 20 for illustrating the positional relationship between the toner bag 100 and the tension coil springs 201 and 202. FIG. 21 is a sectional view of the developing unit 20 for illustrating the positional relationship between the toner bag 100 and the tension coil springs 201 and 202.

As shown in FIG. 18, the toner accommodating container 21 is provided with the tension coil springs 201 and 202 over the longitudinal direction of the cartridge B. The fixing method of the tension coil springs 201 and 202 is similar to that in Embodiment 1.

As shown in (a) of FIG. 19, the tension coil spring 201 is disposed, with respect to the tension coil spring 202, in an upper position spaced from the toner discharge holes 103*a* of the toner bag 100 in an attitude such that the cartridge B is mounted in the main assembly of the image forming apparatus A.

That is, with an increasing distance of the bottom surface 103*d* of the toner bag 100 from the toner discharge holes 103*a*, the tension coil springs 201 and 202 are disposed so that the position of the bottom surface 103*d* is increased in height from the tension coil spring 202 to the tension coil spring 201.

In this embodiment, by the positions of the above-disposed tension coil springs 201 and 202, the position of the bottom surface 103*d* of the toner accommodating bag 103 is set so as to be increased in height with the increasing distance from the toner discharge holes 103*a*. This setting may also be made by a method in which a force for pushing up the bottom surface 103*d* of the toner accommodating bag 103 by the tension coil spring 201 is set at a value larger than a force for pushing up the bottom surface 103*d* of the toner accommodating bag 103 by the tension coil spring 202 or the like method.

When the toner bag 100 is accommodated in the toner accommodating container 21, the tension coil springs 201 and 202 are pushed down in an arrow Z1 direction in (a) of FIG. 19 by the toner bag 100, thus being moved to positions shown in (a) of FIG. 19.

Then, with a decreasing amount of the toner 2, the tension coil springs 201 and 202 push up the bottom surface 103*d* of the toner bag 100 in an arrow Z2 direction in (a) of FIG. 19 from a state shown in (a) of FIG. 19 to a state shown in (b) of FIG. 19.

Simultaneously with this operation, the contact positions of the tension coil springs 201 and 202 with the bottom surface 103*d* are gradually moved in the arrow Y direction in (a) of FIG. 19 along the bottom surface 103*d*.

That is, the contact positions of the tension coil springs 201 and 202 with the bottom surface 103*d* are moved to positions shown in (a) of FIG. 20. In (a) of FIG. 20, solid lines represent the positions of the tension coil springs 201 and 202 shown in (a) of FIG. 19, and broken lines represent the positions of the tension coil springs 201 and 202 shown in (b) of FIG. 19.

In this way, the toner 2 in the toner bag 100 is loosened by moving the contact positions of the tension coil springs 201 and 202 with the bottom surface 103*d*, so that it is possible to discharge the toner 2 into the toner chamber 29 more satisfactorily.

Further, as shown in FIG. 21, the sheet member 43*a* provided on the feeding member 43 acts on the toner bag 100, and also when the toner bag 100 causes the swing motion, the contact positions of the tension coil springs 201 and 202 with the bottom surface 103*d* of the toner bag 100 are changed. In (b) of FIG. 20, the positions of the tension coil springs 201 and 202 shown in (a) of FIG. 19 are represented by solid lines, and the positions of the tension coil springs 201 and 202 shown in FIG. 21 are represented by broken lines.

That is, as shown in (b) of FIG. 20, the contact positions of the tension coil springs 201 and 202 with the toner bag 100 are moved to the positions indicated by the broken lines shown in (b) of FIG. 20, respectively, when the sheet member 43*a* acts on the toner bag 100.

In this way, by repetition of the swing motion of the toner bag 100, movement of the contact positions of the tension coil springs 201 and 202 with the bottom surface 103*d* of the toner bag 100 is also repeated. As a result, the toner 2 in the toner bag 100 is loosened, so that the toner 2 can be more satisfactorily discharged into the toner chamber 29. Incidentally, constituent elements which are the same as those in Embodiments 1 and 2 are represented by the same reference numerals or symbols and will be omitted from description.

[Embodiment 4]

Structure of a cartridge, a developing cartridge, a process cartridge and an image forming apparatus according to the present invention in Embodiment 4 will be described with reference to FIGS. 22 and 23. Incidentally, constituent elements which are the same as those in Embodiments 1 and 2 are represented by the same reference numerals or symbols and will be omitted from description.

In this embodiment, tension coil springs 203 and 204 as the elastic member are provided so that directions of the tension coil springs 203 and 204 acting on the toner bag 100 cross each other with respect to the longitudinal direction (left-right direction in FIG. 23) of the cartridge B and are tilted relative to each other at a predetermined angle.

As a result, also in this embodiment, the tension coil springs 203 and 204 positively act on the toner 2 in the toner bag 100 to improve the toner discharging property.

FIG. 18 is an exploded perspective view for illustrating fixing positions of the tension coil springs 203 and 204. FIG. 23 is a plan view of the developing unit 20 for illustrating the positional relationship between the toner bag 100 and the tension coil springs 203 and 204.

The contact positions of the tension coil springs 203 and 204 with the bottom surface 103*d* are changed by a decrease in amount of the toner 2 or swing motion of the toner bag 100. For this purpose, acting directions of the tension coil springs 203 and 204 are tilted with respect to the longitudinal direction of the cartridge B.

Therefore, as shown in FIGS. 22 and 23, the tension coil springs 203 and 204 are disposed. As shown in FIG. 22, in the case where the acting directions of the tension coil springs 203 and 204 are tilted with respect to the longitudinal direction of the cartridge B, when the toner bag 100 is accommodated in the toner accommodating container 21, the tension coil springs 203 and 204 are moved to positions indicated by solid lines in FIG. 23.

Then, with a decrease in amount of the toner 2, the contact positions of the tension coil springs 203 and 204 with the toner bag 100 are moved to positions indicated by broken lines in FIG. 23.

Further, when the sheet member 43*a* acts on the toner bag 100 to swing the toner bag 100, the contact positions of the tension coil springs 203 and 204 with the bottom surface 103*d* of the toner bag 100 are moved to positions indicated by chain lines in FIG. 23.

Therefore, the toner 2 in the toner bag 100 is loosened, so that the toner 2 can be more satisfactorily discharged into the toner chamber 29.

[Embodiment 5]

Structure of a cartridge, a developing cartridge, a process cartridge and an image forming apparatus according to the present invention in Embodiment 5 will be described with reference to FIG. 24. Incidentally, constituent elements which are the same as those in Embodiments 1 to 4 are represented by the same reference numerals or symbols and will be omitted from description.

In this embodiment, tension coil springs 205 and 206 as the elastic member are provided inside the toner accommodating bag 103 as the frame with respect to a direction crossing the longitudinal direction of the cartridge B so as to cross each other. FIG. 24 is an exploded perspective view for illustrating fixing positions of the tension coil springs 205 and 206. Other constitutions are the same as those in Embodiments 1 to 4 described above, and a similar effect can be obtained.

As described above, according to the present invention, a clearance (gap) between the developing container 23 and the toner bag 100 necessary to ensure the vibration of the toner bag 100 during discharge of the toner 2 can be provided efficiently. For that reason, without upsizing the developing unit 20, the toner 2 in the flexible toner bag 100 can be discharged satisfactorily to decrease the amount of the remaining toner.

Incidentally, in the above-described embodiments, as an example of the cartridge B detachably mountable to the main assembly of the image forming apparatus A, the process cartridge was described.

Further, the process cartridge includes the toner bag 100, the photosensitive drum 62 on which the electrostatic latent image is to be formed, and the developing roller 32 for supplying the toner 2, contained in the toner bag 100, to the surface of the photosensitive drum 62.

Further, a constitution in which the cartridge B consisting of the process cartridge is detachably mountable to the image forming apparatus A and the image is formed on the sheet P was employed.

As another example of the cartridge detachably mountable to the main assembly of the image forming apparatus A, the developing cartridge may also be employed.

Further, the developing cartridge is constituted by including the toner bag 100 and the developing roller 32 for supplying the toner 2, contained in the toner bag 100, to the surface of the photosensitive drum 62 on which the electrostatic latent image is to be formed.

Further, a constitution in which the developing cartridge is detachably mountable to the image forming apparatus A and the image is formed on the sheet P may also be employed.

Incidentally, functions, materials, shapes and relative arrangement of the constituent elements or parts in the present invention are not limited to those described in the above-described embodiments unless otherwise specified.

There are a constitution in which the bottom surface of the developer bag has no inclination enough to permit drop of the developer toward the developer discharging opening by the self-weight of the developer and a constitution in which the opening of the developer bag cannot be formed in a lower side with respect to the direction of gravitation. Also in these constitutions, according to the present invention, elastic energy accumulated by extension of the elastic member acts on the developer bag, so that it is possible to satisfactorily discharge the developer through the opening.

Therefore, the remaining amount of the developer in the flexible developer bag can be decreased, so that more images can be formed by the developer in a limited amount, accommodated in the developer bag.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 011988/2013 filed Jan. 25, 2013, which is hereby incorporated by reference.

What is claimed is:

1. A cartridge detachably mountable to a main assembly of an image forming apparatus, said cartridge comprising:

a frame;

a flexible developer bag for containing developer, said developer bag being (i) provided with an opening and (ii) provided inside of said frame; and an elastic member for acting on said developer bag, wherein elastic energy accumulated by extension of said elastic member acts on said developer bag to discharge the developer through the opening, and wherein said elastic member comprises a plurality of elastic member portions.

2. A cartridge according to claim 1, further comprising an acting member periodically actable on said elastic member.

3. A cartridge according to claim 1, wherein a force for pushing said developer bag by said elastic member at a longitudinal central portion of said cartridge is greater than a force at a longitudinal end portion of said cartridge.

4. A cartridge according to claim 1, wherein said elastic member supports said developer bag by tilting a bottom surface of said developer bag relative to a horizontal surface by a predetermined angle in a state in which the opening of said developer bag is directed downward.

5. A cartridge according to claim 2, wherein said developer bag is supported by said frame at an upper portion thereof and is swingable, and wherein said acting member periodically acts on said elastic member by periodically contacting said developer bag.

6. A cartridge according to claim 1, wherein said developer bag includes a crease capable of being projected at a rear surface portion in a position opposite from the opening of said developer bag toward a space in which the developer is contained.

7. A cartridge according to claim 2, wherein said acting member also functions as a feeding member for feeding the developer in said cartridge.

8. A cartridge according to claim 1, wherein said elastic member is provided so that a direction of said elastic member acting on said developer bag is tilted relative to a longitudinal direction of said cartridge by a predetermined angle.

9. A cartridge according to claim 1, wherein said elastic member is provided inside said frame, and said plurality of elastic member portions are provided in a direction crossing a longitudinal direction of said cartridge.

10. A cartridge according to claim 1, wherein said elastic member is provided inside said frame, and said plurality of elastic member portions are provided in a direction crossing a longitudinal direction of said cartridge so that said elastic member portions are tilted relative to each other at a predetermined angle.

11. A cartridge according to claim 1, wherein said elastic member is provided inside said frame and, and said plurality of elastic member portions are provided in a direction crossing a longitudinal direction of said cartridge so that said elastic member portions cross each other.

12. A cartridge according to claim 1, wherein said elastic member is provided inside said frame and said plurality of elastic member portions are provided substantially in parallel with a longitudinal direction of said cartridge.

13. A cartridge according to claim 1, wherein said elastic member is provided inside said frame and said plurality of elastic member portions are provided substantially in parallel with a longitudinal direction of said cartridge at different positions in height.

14. A developing cartridge comprising:

cartridge according to claim 1; and a developer carrying member for supplying developer to a surface of an image bearing member on which an electrostatic latent image is to be formed.

15. A process cartridge comprising:

cartridge according to claim 1;

an image bearing member on which an electrostatic latent image is to be formed; and a developer carrying member for supplying developer to a surface of said image bearing member.

16. An image forming apparatus comprising:

a developing cartridge according to claim 14, wherein an image is to be formed on a sheet material.

17. A cartridge detachably mountable to a main assembly of an image forming apparatus, said cartridge comprising:

a frame;

a flexible developer bag for containing developer, said flexible bag being (i) provided with an opening and (ii) provided inside of said frame; and an elastic member for acting on said developer bag, wherein a force for pushing said developer bag by said elastic member at a longitudinal central portion of said cartridge is greater than a force at a longitudinal end portion of said cartridge.

18. A cartridge according to claim 17, wherein said elastic member is provided at a plurality of positions.

* * * * *